US010632766B2

(12) United States Patent
De Roeck

(10) Patent No.: US 10,632,766 B2
(45) Date of Patent: Apr. 28, 2020

(54) PRINTING DEVICE WITH CONVEYOR BELT

(71) Applicant: AGFA NV, Mortsel (BE)

(72) Inventor: Luc De Roeck, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 16/348,878

(22) PCT Filed: Nov. 8, 2017

(86) PCT No.: PCT/EP2017/078547

§ 371 (c)(1),
(2) Date: May 10, 2019

(87) PCT Pub. No.: WO2018/087119

PCT Pub. Date: May 17, 2018

(65) Prior Publication Data

US 2019/0270320 A1 Sep. 5, 2019

(30) Foreign Application Priority Data

Nov. 14, 2016 (EP) ..... 16198588

(51) Int. Cl.
*B41J 11/00* (2006.01)
*B41J 3/407* (2006.01)

(52) U.S. Cl.
CPC ..... *B41J 11/0085* (2013.01); *B41J 3/407* (2013.01); *B41J 11/007* (2013.01); *B41J 3/4078* (2013.01)

(58) Field of Classification Search
CPC ..... B41J 11/0085; B41J 3/407; B41J 11/007; B41J 3/4078
See application file for complete search history.

(56) References Cited

U.S. PATENT DOCUMENTS 9,987,864 B2 * 6/2018 Nakano ..... A61J 3/00
10,486,440 B2 * 11/2019 Hirano ..... A61J 3/007
2015/0336406 A1 * 11/2015 Hobo ..... B41J 11/007 347/104
2016/0257141 A1 * 9/2016 De Roeck ..... B41J 11/007

FOREIGN PATENT DOCUMENTS

EP 3 067 211 A1 9/2016

OTHER PUBLICATIONS

Official Communication issued in International Patent Application No. PCT/EP2017/078547, dated Jan. 25, 2018.

* cited by examiner

*Primary Examiner* — Henok D Legesse
(74) *Attorney, Agent, or Firm* — Keating and Bennett, LLP

(57) ABSTRACT

An inkjet printer, and a printing method with the inkjet printer, includes a first conveyor belt wrapped around a vacuum table and supported by an upstream pulley and a downstream pulley and a vacuum area on the first conveyor belt, and a second conveyor belt wrapped-around the first conveyor belt and supported by an upstream sliding support and a downstream sliding support. The second conveyor belt is adhered in the vacuum area by vacuum power and a print receiver is attached to the second conveyor belt for conveying and printing.

15 Claims, 3 Drawing Sheets

PRINTING DEVICE WITH CONVEYOR BELT

CROSS REFERENCE TO RELATED APPLICATIONS

This application is a 371 National Stage Application of PCT/EP2017/078547, filed Nov. 8, 2017. This application claims the benefit of European Application No. 16198588.2, filed Nov. 14, 2016, which is incorporated by reference herein in its entirety.

BACKGROUND OF THE INVENTION

1. Field of the Invention

The present invention relates to a printing device, such as an offset press, or an inkjet printer, to print on difficult manageable print receivers which are conveyed by a conveyor belt in the printing device.

2. Description of the Related Art

Inkjet printing devices with a vacuum belt, as vacuum support for the substrate, to transport a substrate underneath a print head are well-known. Such inkjet printing devices currently are adapted for sign & display market with small sized substrates to much larger substrates or multiple substrates, printed at the same time, for industrial market; and special substrates such as manufacturing methods for glass, laminate floorings, carpets, textiles comprising inkjet printing methods. An example of such inkjet printing device is Agfa Graphics™: Jeti Tauro.

One of the issues with the current inkjet printing device from the state-of-the-art is the possibility to handle, to transport, to print on all kind of substrates. Especially the transport systems with conveyor belt of these inkjet printing devices needs to be adapted to enlarge the versatility so more print receivers can be transported in the inkjet printing device.

Now-a-days a printing facility has several types of inkjet printing devices in his facility. Each inkjet printing devices is capable of transporting a certain set of print receivers. The use of multiple inkjet printing devices makes it economically inefficient to fill daily all these inkjet printer devices with print-jobs and in an industrial environment 7-days-on-7 days. Each inkjet printing device in production need also separate calibration time and refurbishing time, whether or not, together with specific inkjet printing device knowledge. That is why there is a need for inkjet printing devices which are capable of using all kind of substrates to print-on so productivity becomes higher on the inkjet printing devices with less loss of service and calibration of the inkjet printing devices.

Therefore there is a need of an inkjet printing device which may handle all kind of substrates including crease-sensitive print receiver; brittle print receiver, edge-curl sensitive print receiver and rough back-side print receiver, without tweaking and tuning of parameters from the inkjet printing device which influences the print quality on these kinds of substrates such as sharpness, adhesion on the substrate and wrinkles in the printed images and thus without admitting the print quality.

US 2016/257141 (DE ROECK LUC) discloses an inkjet printer comprise movable vacuum divider in a vacuum chamber to handle different sized print receivers.

Some inkjet printing devices in the state-of-the-art comprises a sticky conveyor belt to handle crease-sensitive print receivers, such as textile but also in here the type of sticky layer is adapted for a certain set of such print receivers. If another type of print receiver has to be printed than it is possible the sticky layer on the conveyor belt have to be changed. The removal of such sticky layer takes a huge amount from the production time and is mostly not environmentally friendly for the operator of the inkjet printer and also apply a new sticky layer with another kind of adhesive takes a second huge amount from the production time. To overcome this large loss of production time there is need for a new type of transport system in inkjet printers.

SUMMARY OF THE INVENTION

Preferred embodiments of the present invention provide an inkjet printer and a printing method on this inkjet printer which improves the handling of specific print receivers while conveying them on a conveyor belt. These specific print receivers are selected from the group comprising crease-sensitive print receiver (200); brittle print receiver (200), edge-curl sensitive print receiver (200) and rough back-side print receiver (200). The present invention makes the inkjet printer also employable in an industrial environment for these kinds of specific print receivers, such as in the textile industry or leather industry.

The present invention makes the inkjet printer versatile by printing on any kind of print receivers. The print receivers which are transported easily on the conveyor belt can still be used but for these specific print receivers an extra conveyor belt is mounted on top of the first conveyor belt (300, $CB_2$) to easily transporting these specific print receivers as become clear in the following descriptions of the present invention. The film used to form this second conveyor belt (400, $CB_2$) may be adapted for a certain print receiver (200) such as a specific adhesive layer which is compatible with this print receiver (200).

The present invention is an inkjet printer together with an inkjet printing method on this inkjet printer which comprises:

- a first conveyor belt (300, $CB_1$) which is wrapped around a vacuum table and supported by an upstream pulley ($P_{upstream}$) and a downstream pulley ($P_{downstream}$); and
- a vacuum area ($A_{vacuum}$) on the first conveyor belt (300, $CB_1$); and
- a second conveyor belt (400, $CB_2$) which is wrapped around the first conveyor belt (300, $CB_1$); and which is supported by an upstream sliding support (450, $S_{upstream}$) and a downstream sliding support (450, $S_{downstream}$); and
- wherein the second conveyor belt (400, $CB_2$) is adhered in the vacuum area ($A_{vacuum}$) by vacuum power
- wherein a print receiver (200) is attached to the second conveyor belt (400, $CB_2$) for conveying and printing.

The second conveyor belt (400, CB2) is in the present invention replaceable and adhered by vacuum power to the first conveyor belt (300, CB1) whereby the second conveyor belt (400, CB2) is transportable by the first conveyor belt when the first conveyor belt (300, CB1) moves forward/backward.

The print receiver (200) is attachable to the second conveyor belt (400, CB2) for conveying and printing or in other words the second conveyor belt (400, $CB_2$) is for conveying a print receiver (200) which is attachable to the second conveyor belt (400, $CB_2$).

The printing method of the present invention is an inkjet printing method wherein a print receiver (200) is conveyed in an inkjet printer which comprises:

a first conveyor belt (300, $CB_1$) which is wrapped around a vacuum table and supported by an upstream pulley ($P_{upstream}$) and a downstream pulley ($P_{downstream}$); and a vacuum area ($A_{vacuum}$) on the first conveyor belt (300, $CB_1$); and a second conveyor belt (400, $CB_2$) which is wrapped around the first conveyor belt (300, CB1); and which is supported by an upstream sliding support (450, $S_{upstream}$) and a downstream sliding support (450, $S_{downstream}$); and wherein the inkjet printing method comprises the steps of: adhering the second conveyor belt (400, $CB_2$) in the vacuum area ($A_{vacuum}$) by vacuum power; and attaching the print receiver (200) to the second conveyor belt (400, $CB_2$) for conveying and printing. Preferably the sliding supports are movable away from the inkjet printer when not in use.

The use of a second conveyor belt (400, $CB_2$) wrapped around the first conveyor belt makes it possible to print on all kind of print receivers. The easy handled print receivers can be print on the first conveyor belt (300, $CB_1$) such as known in the state-of-the-art and the difficult transporting print receivers may be conveyed on top of the second conveyor belt (400, $CB_2$). This improves the versatility of the inkjet printers versus the inkjet printers of the state-of-the-art.

Preferably the second conveyor belt (400, $CB_2$) comprises a sticky layer for conveying the print receiver (200) and for adhering the print receiver (200) to the second conveyor layer. The sticky layer comprises preferably water soluble adhesives, thermoplastic adhesive, pressure sensitive adhesive, permanent adhesive or a fibrillar adhesive system. This sticky layer adhere the print receiver (200) better to the second conveyor belt (400, $CB_2$).

In a preferred embodiment is the tension of the second conveyor belt (400, $CB_2$) from the downstream sliding support (450, $S_{downstream}$) to the upstream sliding support (450, $S_{upstream}$) lower than the tension of the first conveyor belt (300, $CB_1$) from the upstream pulley ($P_{upstream}$) to the downstream pulley ($P_{downstream}$) preferably while printing. The tension of the second conveyor belt (400, $CB_2$) from the downstream sliding support (450, $S_{downstream}$) to the upstream sliding support (450, $S_{upstream}$) is preferably lower than 98% of the tension of the first conveyor belt (300, $CB_1$) from the upstream pulley ($P_{upstream}$) upstream) to the downstream pulley ($P_{downstream}$) more preferably while printing. The tension of the second conveyor belt (400, $CB_2$) from the downstream sliding support (450, $S_{downstream}$) to the upstream sliding support (450, $S_{upstream}$) is preferably lower than 95% of the tension of the first conveyor belt (300, $CB_1$) from the upstream pulley ($P_{upstream}$) to the downstream pulley ($P_{downstream}$) more preferably while printing. It is found that the tensioning of the second conveyor belt (400, $CB_2$) may not that hard else crinkles may occur or bad adhering of the print receiver (200) may happen which both influences the print quality badly. This makes it also easy for mounting the second conveyor belt ($CB_2$) in the inkjet printer of the present invention which is an economically benefit for the printing industry: they can easily and fast switch between several types of second conveyor belts or easily replace a second conveyor belt (400, $CB_2$) because the specification for the tensioning of the second conveyor belt in the present invention is less than the specification for the tensioning of the first conveyor belt (300, $CB_1$) which takes a much longer time for mounting in the inkjet printer around its pulleys. The fast changing/replacing of the second conveyor belt (400, $CB_2$) makes it also possible to select the correct second conveyor belt (400, $CB_2$) for a specific print receiver (200) for example a second conveyor belt (400, $CB_2$) with a stronger adhesive layer.

In another preferred embodiment is the tension of the second conveyor belt (400, $CB_2$) from the downstream sliding support (450, $S_{downstream}$) to the upstream sliding support (450, $S_{upstream}$) substantially untensioned when the inkjet printer is in a printing mode and/or when the inkjet printer is printing. It is found when the second conveyor belt (400, $CB_2$) is tensioned hardly around the first conveyor belt ($CB_1$) the print receivers still get not attached very well to the second conveyor belt (400, $CB_2$) so for example crinkles can occur which influences the print quality badly. The untensioned manner between these sliding supports prevents the occurrence of crinkles and/or bad attaching of the print receiver (200) against the second conveyor belt ($CB_2$).

Several materials can be used for the second conveyor belt but the following preferred embodiment uses a film for forming, as material, the second conveyor belt (400, $CB_2$) which is extruded from a thermoplastic polymer preferably comprising polyamides, polyester or polyolefins, polyethylene, polypropylene or uses a film for forming the second conveyor belt (400, $CB_2$) comprising synthetic fibers which are both selected from the group polyamides, polyester or polyolefins, polyethylene, polypropylene. These materials have a lot of advantages such as low-cost, and/or heat-resistance. The film is in the present invention a re-usable object that can be re-used several times so it becomes a consumable product for the inkjet printer of the present invention.

In a preferred embodiment the film which forms the second conveyor belt (400, $CB_2$) is a rectangular film which has at one connection side of the rectangular film a female registration element and at the other connection side a male registration element so a linkage between female registration element and the male registration element forms the second conveyor belt (400, $CB_2$). The female registration and male registration makes a fast mounting of the second conveyor belt (400, $CB_2$) possible which is in an industrial environment an economical advantage.

The film from the previous preferred embodiments may comprise marks for indexing the speed and/or position of the second conveyor belt (400, $CB_2$). The speed of the second conveyor belt (400, $CB_2$) defines the transport speed of the print receiver (200) mounted on the second conveyor belt (400, $CB_2$). Because the close contact of the print receiver (200) and the measuring of the speed of the second conveyor belt (400, $CB_2$) by these marks the marking device of the inkjet printer, such as a print-head, may be driven by the measurements of these marks to guarantee the correct registration of the markings which results in the best print quality.

The above and other elements, features, steps, characteristics and advantages of the present invention will become more apparent from the following detailed description of the preferred embodiments with reference to the attached drawings.

BRIEF DESCRIPTION OF THE DRAWINGS

The drawings are examples of preferred embodiments to illustrate the present invention. They all are cross-section of an inkjet printing device (100) which is not shown on the drawings. Each inkjet printing device from the drawings comprises a print head (50) which marks the print receiver (200) with an image (250). Not all print heads are shown. The print receiver (200) in these drawings is a web material and the inkjet printing device shows a roll-to-roll configuration. The inkjet printing device comprises a vacuum belt system with a first conveyor belt (300, $CB_1$) and vacuum table (150) wherein the first conveyor belt (300, $CB_1$) is wrapped around a pair of pulleys (350). The left pulley is in the description also called the upstream pulley ($P_{upstream}$) and the right pulley is in the description also called the downstream pulley ($P_{downstream}$). A second conveyor belt (400, $CB_2$) is wrapped around the first conveyor belt (300, $CB_1$). To mount the print receiver (200) to the second conveyor belt (400, $CB_2$) a roll (175) is mounted in the upstream zone, which is the zone before the print zone and to release the print receiver (200) from the second conveyor belt ($CB_2$) another roll (185) is mounted in the download zone. Each arrow shows the direction of the movement from the second conveyor belt (400), first conveyor belt (300) or print receiver (200).

DETAILED DESCRIPTION OF THE PREFERRED EMBODIMENTS

Printing Device

Figure 1:
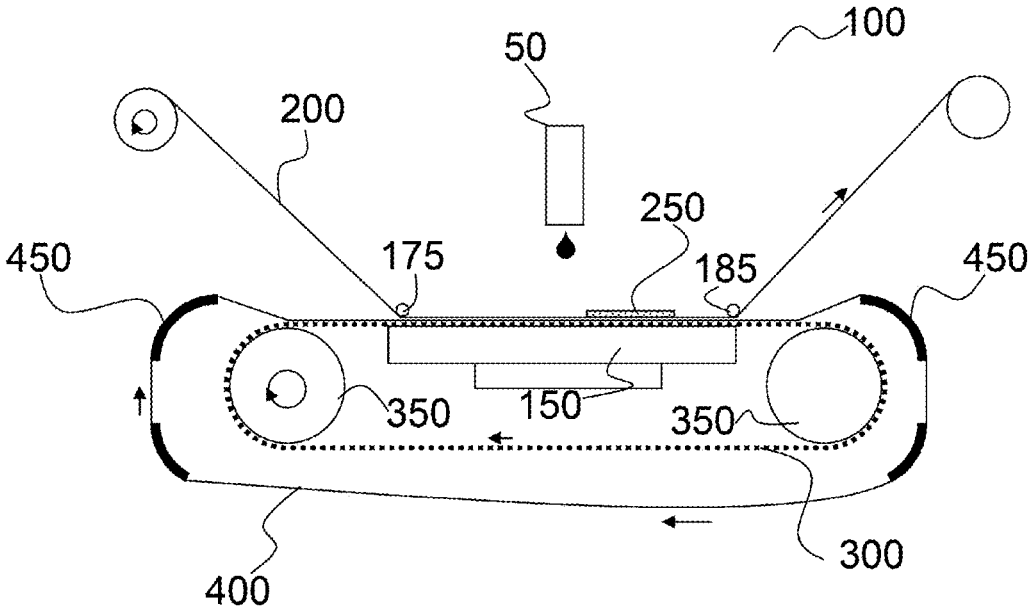
FIG. 1 shows two sliding supports (450) where over the second conveyor belt (400, $CB_2$) is conveyed. The left sliding support (450) is in the description also called the upstream sliding support (450, $S_{upstream}$) and the right sliding support (450) is in the description also called the downstream sliding support (450, $S_{downstream}$).
Figure 2:
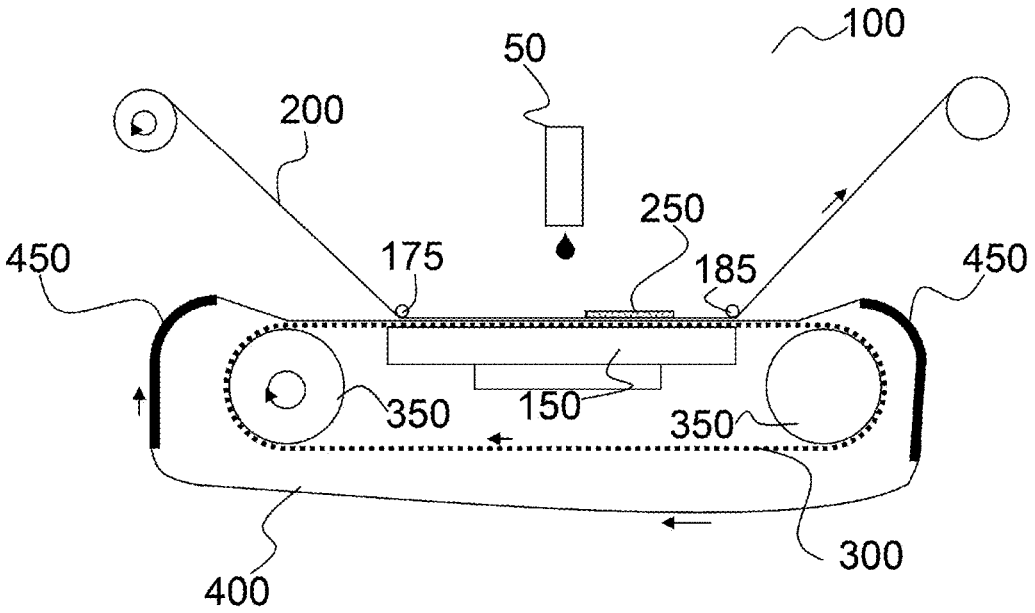
FIG. 2, and FIG. 3, FIG. 4 show other types of sliding supports (450) or different mounted sliding supports (450) where over the second conveyor belt (400, $CB_2$) is conveyed.

A printing device is a device which marks a pattern on a surface of a print receiver (200) such as paper. The marking of a pattern on a surface is also called printing. The pattern represents an image which may be text, photograph, graphic or logo. The pattern is mostly the result of a halftoning method of the image such as an error-diffusion method or an amplitude modulation halftoning method. The pattern may have an achromatic or chromatic color.

The marking of the printing device may be done by any conventional printing technology such as offset printing, gravure printing, letterpress printing, screen printing. These conventional printing methods are all described in 'Chapter 2. *Printing Technologies With Permanent Printing Master*', P 204-448 in '*Handbook of Print Media, Technologies and Production Methods*' by Helmut Kipphan, ISBN 3-540-67326-1 Springer-Verlag Berlin Heidelberg New York, 2001. Such printing device is also called a conventional printing device.

Preferably the printing device in the present invention is a digital printing device such as a electrophotography-based, devices, iconography-based, magnetography-based, inkjet-based printing device. A digital printing device is sometimes called a printer. These digital printing methods are all described in 'Chapter 4. *Printing Computer to . . . Technologies*', 'Subchapter 4.5 *Computer to Print*', P 657-674, and 'Chapter 5. Printing Technologies without a Printing Plate (NIP Technologies)', P 676-758 in '*Handbook of Print Media, Technologies and Production Methods*' by Helmut Kipphan, ISBN 3-540-67326-1 Springer-Verlag Berlin Heidelberg New York, 2001. The printing device may be a hybrid printing device wherein conventional printing technologies and digital and/or non-impact printing technologies are combined in a printing device.

A preferred printing technology for the present invention is an inkjet printing technology. The printing device from the present invention is thus preferably an inkjet printer which is a printing device comprising an inkjet print head (50). The inkjet technology may be continuous inkjet or drop on demand inkjet which is preferably selected from the group thermal inkjet, piezo inkjet and electrostatic inkjet. The inkjet printer is preferably a large-format inkjet printer wherein printable width of more than 135 cm are common but also printable widths of more than 300 cm and even more than 500 cm until 10 meter. An example of such large-format inkjet printer in a multi-pass inkjet printing method is Jeti Tauro™ manufactured by Agfa Graphics™ with a maximum printable width of 254 cm and which can accommodate for example rigid media up to 400 cm in length. An example of another large-format inkjet printer with a single-pass inkjet printing method is KBA RotaJet™ L-series with a maximum print width of 1.3 meter.

The inkjet printer may comprise a page-wide inkjet printhead which covers the whole width or larger than the width of the print receiver (200). In a preferred embodiment the pattern is inkjet printed in one pass, also called single-pass inkjet printing method, which guarantees an economical benefit by having larger throughputs than in a multi-pass inkjet printing method. Detailed information on inkjet technologies and building-up of inkjet printers can be found in '*Inkjet Technology and Product Development Strategies*' by Stephen F. Pond, Torrey Pines, 2000.

To enhance the adhesion of the pattern on the print receiver (200) the printing device may comprise a dryer to dry the marked pattern on the print receiver (200) and/or to have a better adhesion of the marked pattern on the print receiver (200). A typical dryer, sometimes also called curing device, in such printing devices comprises an ultraviolet light (UV) source and/or infrared (IR) radiation source.

The drying of the marked pattern may be done by radiation (UV and/or IR and/or NIR and/or SWIR) from the back-side to the printed side of the print receiver (200). Or the drying of the marked pattern may be done by radiation (UV and/or IR and/or NIR and/or SWIR) above the marked pattern.

Any ultraviolet light source, as long as part of the emitted light, may be employed as a radiation source, such as a high or low pressure mercury lamp, a cold cathode tube, a black light, an ultraviolet LED, an ultraviolet laser, and a flash light. In a preferred embodiment, the printing device contains one or more UV LEDs with a wavelength larger than 360 nm, preferably one or more UV LEDs with a wavelength larger than 380 nm, and most preferably UV LEDs with a wavelength of about 395 nm. Furthermore, it is possible to dry the pattern using, consecutively or simultaneously, two light sources of differing wavelength or illuminance. For example, the first UV source can be selected to be rich in UV-C, in particular in the range of 260 nm-200 nm. The second UV source can then be rich in UV-A, e.g. a gallium-doped lamp, or a different lamp high in both UV-A and UV-B. The use of two UV-sources has been found to have advantages e.g. a fast drying speed and a high drying degree. Ultraviolet Light source is also called UV source.

The IR source is preferably a NIR source (=Near Infra-Red source) such as a NIR lamp or a SWIR (=Short Wave Infra-Red source) such as a SWIR lamp. The IR source may comprise carbon infrared emitters which has a very short response time. An IR source is also called infrared radiation source. The IR source may comprise an air blower for blowing hot air warmed up by the IR source.

Preferred infrared radiation sources include near infrared radiation sources (NIR: 750-1400 nm) and short wave infrared radiation sources (SWIR: 1400-3000 nm). An advantage is that glass lenses, which may be included in the curing device for focusing the infrared light on the substrate, transmit in this infrared region, contrary to mid-wavelength infrared light (MWIR: 3000-8000 nm) or long-wavelength infrared light (LWIR: 8000-15000 nm). The most preferred infrared light source is a SWIR light source because the water absorption significantly increases at 1450 nm. A commercial example of a SWIR light source is a carbon infrared emitter CIR™ available from HERAEUS, for example emitting at a wavelength of about 2000 nm. Commercially available NIR emitters are available from ADPHOS™.

The printing device of the present invention comprises, expressed in another way:

a marking device for marking a print receiver (200);

a first conveyor belt (300, $CB_1$), supported by a upstream pulley ($P_{upstream}$) and downstream pulley ($P_{downstream}$) comprising a print area ($A_{print}$) and vacuum area ($A_{vacuum}$).

pair of sliding supports as support for the second conveyor belt (400, $CB_2$) wherein the pair of sliding supports comprises a first sliding support (450) (=upstream sliding support (450, $S_{upstream}$)) and a second sliding support (450) (=downstream sliding support (450, $S_{downstream}$)); wherein the second sliding support (450, $S_{downstream}$) is constructed downstream the print area ($A_{print}$) or the vacuum area ($A_{vacuum}$); and wherein the first sliding support (450, $S_{upstream}$) is constructed upstream the print area ($A_{print}$) or the vacuum area ($A_{vacuum}$); and wherein the second conveyor belt (400, $CB_2$) is supported in print area ($A_{print}$) or the vacuum area ($A_{vacuum}$). The sliding supports where over the second conveyor belt (400, $CB_2$) is wrapped may each be comprised in a pulley.

The vacuum area ($A_{vacuum}$) preferably overlaps the print area ($A_{print}$) because the adhering by vacuum power while printing is of a big importance in print quality such as dot placement accuracy. The print area ($A_{print}$) (size and form) is mainly defined by the marking device and its movement (or not), such as a back and forth movable inkjet printhead in a multi-pass inkjet printer, and the vacuum area ($A_{vacuum}$) (size and form) is mainly defined by the apertures in the first conveyor belt (300, $CB_1$) and the vacuum power of the vacuum table underneath the first conveyor belt (300, $CB_1$), which is a vacuum belt.

The print area ($A_{print}$) from the printing device of the present invention is preceded by an upstream area ($A_{upstream}$) wherein the print receiver (200) is inserted in/on the printing device and wherein the second conveyor belt (400, $CB_2$) is coming on the first conveyor belt (300, $CB_1$) at an upstream belt contact position ($C_{CB1,\ upstream,\ CB2}$)

$C_{CB1,\ upstream,\ CB2}$ is thus the contact position wherein the second conveyor belt (400, $CB_2$) comes on the first conveyor belt (300, $CB_1$) which is at the upstream side of the printing device from the present invention.

The print area ($A_{print}$) from the printing device of the present invention is followed by a downstream area ($A_{downstream}$) wherein the print receiver (200) is outputted from the printing device and wherein the second conveyor belt (400, $CB_2$) is leaving the first conveyor belt (300, $CB_1$) at a downstream belt contact position ($C_{CB1,\ downstream,\ CB2}$)

$C_{CB1,\ downstream,\ CB2}$ is thus the contact position wherein the second conveyor belt (400, $CB_2$) leaves the first conveyor belt (300, $CB_1$) which is at the downstream side of the printing device from the present invention.

The second conveyor belt (400, $CB_2$) is leaving the upstream sliding support (450, $S_{upstream}$) at a upstream sliding support (450) contact position ($C_{S,upstream}$). The second conveyor belt (400, $CB_2$) is coming on the downstream sliding support (450, $S_{downstream}$) at a downstream sliding support (450) contact position ($C_{S,\ downstream}$).

Print Receiver (200)

The present invention is suitable for marking any kind of material as print receiver (200). The print receiver (200) can be one or a plurality of regular or irregular shaped objects, large or small objects, light or heavy objects. The print side of a print receiver (200) is the side whereon the printing device marks a pattern on the print receiver (200). The back side of a print receiver (200) is the side which is in contact with the printing device, especially a conveyor belt or a vacuum table, while carrying and/or transporting the print receiver (200). In the present invention the back side of a print receiver (200) is in contact with the second conveyor belt (400, CB2) so the print receiver (200) can be conveyed in the printing device. Preferably the print receiver (200) from the present invention is flat wherein a flat side from the print receiver (200) is in contact with the second conveyor belt (400, CB2) of the present invention.

The kind of print receiver (200) defines the material of the first conveyor belt (300, $CB_1$) from the present invention in order to reduce the stretch of the first conveyor belt (300, $CB_1$) from the present invention and to handle easier tension adjustments for this first conveyor belt (300, $CB_1$) between its pulleys.

Preferably the print receiver (200) in the embodiment is a flat workpiece such as paper, rigid sheets, fabric, textile, wood, paperboard, corrugated fiberboard, transparent foils, adhesive PVC sheets or flexible sheets with thickness down to 100 micrometres and preferably down to 50 micrometres, which is carried on the second conveyor belt (400, $CB_2$) from the present invention.

The print receiver (200) is preferably web material, which is carried from a roll on the second conveyor belt (400, $CB_2$) from the present invention. If the marked print receiver (200) is winded on another roll, the configuration is called roll-to-roll. If the marked print receiver (200) is cut in marked sheets by a cutter, the configuration is called roll-to-sheet. The printing device from the present invention comprises preferably such a roll-to-roll configuration or roll-to-sheet configuration, such as a roll-to-sheet-cutting-machine.

The present invention is a big improvement for permeable print receivers such as liquid permeable print receivers. The second conveyor belt (400, $CB_2$) from the present invention prevents that the first conveyor belt (300, $CB_1$) becomes dirt or soiled by the marking of the permeable print receiver (200), such as jetting an ink on the permeable print receiver (200). Typical permeable print receivers and preferred embodiments are textiles, cotton, cloth, flag fabrics, knitted polyester fabrics and flexible material comprising a network of natural or artificial fibres (yarn or thread).

The present invention is a big improvement for absorbent print receivers. The second conveyor belt (400, $CB_2$) from the present invention prevents that the first conveyor belt (300, $CB_1$) becomes dirt or soiled by the marking of the absorbent print receiver (200), if for example jetted ink may not absorbent enough by the absorbent print receiver (200) so the ink is absorbed until the backside of the absorbent print receiver (200). The ink or pre-treatment of the absorbent print receiver (200) may be aggressive, for example due to a high pH of the ink or pre-treatment liquid, for the first conveyor belt (300, $CB_1$) so the second conveyor belt (400, $CB_2$), as consumable product, on top of the first conveyor belt (300, $CB_1$), guarantees a long lifetime of the first conveyor belt (300, $CB_1$).

It is found that the present invention is advantageous, especially when the second conveyor belt (400, $CB_2$) from the present invention is a sticky conveyor belt when the print receiver (200) is selected from the group comprising crease-sensitive print receiver (200); brittle print receiver (200); edge-curl sensitive print receiver (200) and rough back-side print receivers. The conveying is easily handled to mark these kinds of print receivers by the present invention. The present invention prevents for example the creation of rimples in a crease-sensitive print receiver (200), such as textile, which may touch and damage the inkjet printhead in an inkjet printer. Touching of an inkjet printhead may cause a replacement of the inkjet printhead which is economically and environmental not acceptable. In the state-of-the-art the inkjet printheads are adjusted for these kinds of print receivers to have a longer jetting distance so no strikes on the inkjet printheads are guarantees but which results in a lower print quality (resolution, bleeding, inaccurate dot position).

The print area ($A_{print}$) from the printing device of the present invention is preceded by an upstream area ($A_{upstream}$) wherein the print receiver (200) is inserted in/on the printing device and wherein the print receiver (200) is coming attached with the first conveyor belt (300, $CB_1$) at an upstream belt contact position ($C_{CB1,\ upstream,\ printreceiver}$) and is coming on the second conveyor belt (400, $CB_2$) at an upstream belt contact position ($C_{CB2,\ upstream,\ printreceiver}$)

- $C_{CB1,\ upstream,\ printreceiver}$ is thus the contact position wherein the print receiver (200) comes attached with the first conveyor belt which is at the upstream side of the printing device from the present invention.
- $C_{CB2,\ upstream,\ printreceiver}$ is thus the contact position wherein the print receiver (200) comes on the second conveyor belt which is at the upstream side of the printing device from the present invention.

The print area ($A_{print}$) from the printing device of the present invention is followed by a downstream area ($A_{downstream}$) wherein the print receiver (200) is outputted from the printing device and wherein the print receiver (200) is leaving the first conveyor belt (300, $CB_1$) at a downstream belt contact position ($C_{CB1,\ downstream,\ printreceiver}$) and is leaving the second conveyor belt (400, $CB_2$) at a downstream belt contact position ($C_{CB2,\ downstream,\ printreceiver}$)

- $C_{CB1,\ downstream,\ printreceiver}$ is thus the contact position wherein the print receiver (200) detaches from the first conveyor belt (300, $CB_1$) which is at the downstream side of the printing device from the present invention.
- $C_{CB2,\ downstream,\ printreceiver}$ is thus the contact position wherein the print receiver (200) leaves the second conveyor belt (400, $CB_2$) which is at the downstream side of the printing device from the present invention.

The present invention prevents the edge curling of edge-curl sensitive print receiver, such as natural leather, which may touch and misalign a laser head in a laser marking printing device as printing device from the present invention or which may touch and misalign a print head (50) in an inkjet printer as printing device from the present invention. The natural leather is preferably A hide, sometimes called animal skin, which is:

- a rawhide, which is an animal skin removed from an animal. The animal skin is not be tanned;

or

- a tanned hide, which is a rawhide that is tanned in a tannery (611). It is also called tanned natural leather or shortly tanned leather;

or

- crusted hide, which is tanned leather that is crusted. It is also called crusted natural leather or shortly crusted leather (136). The crusted hide is a preferred print receiver for the preferred embodiments of the present invention.

Figure 3:
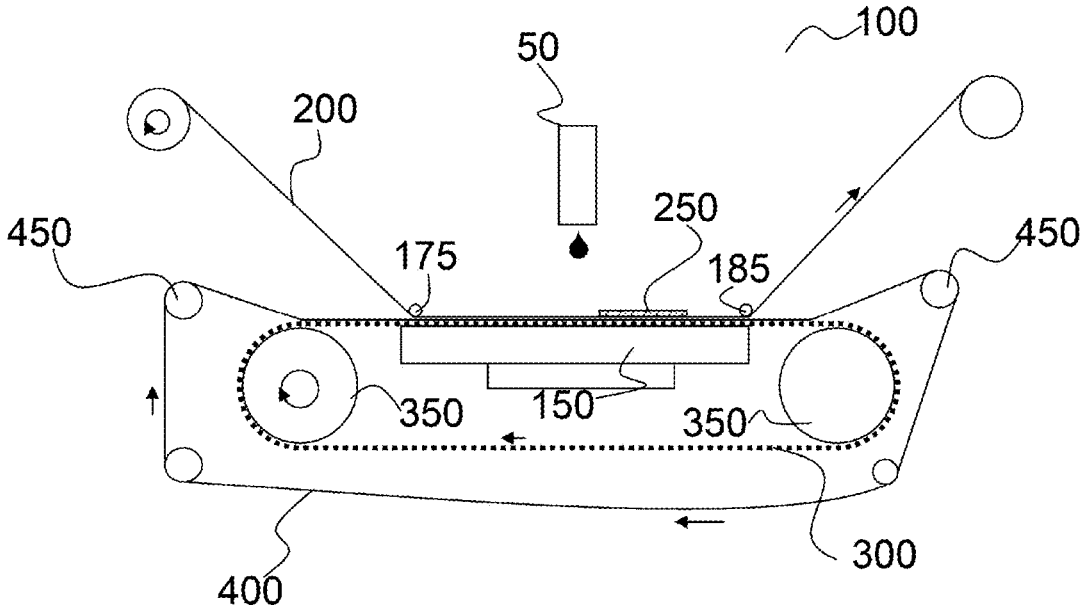
Figure 4:
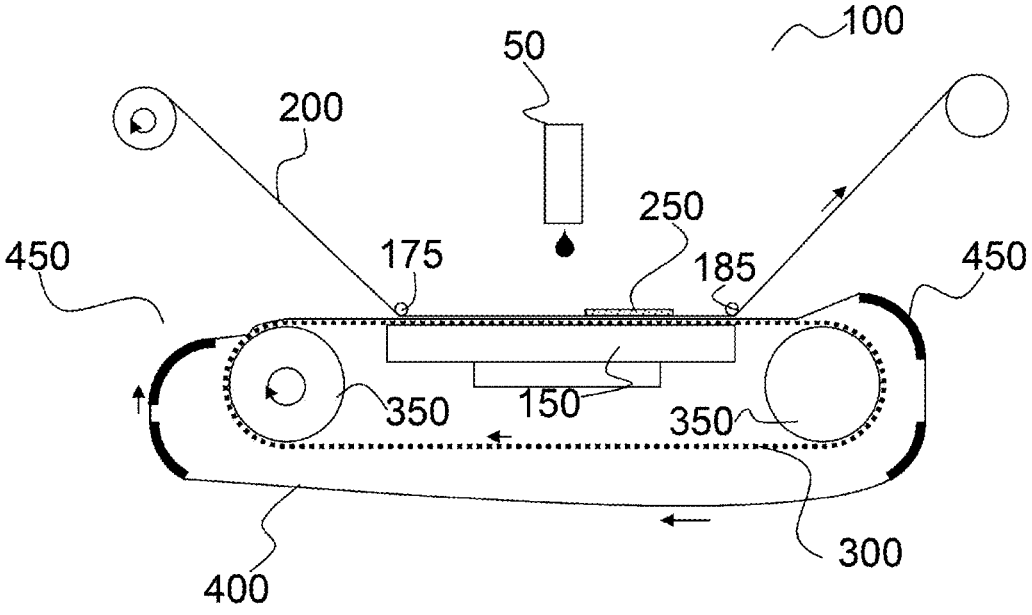
Figure 5:
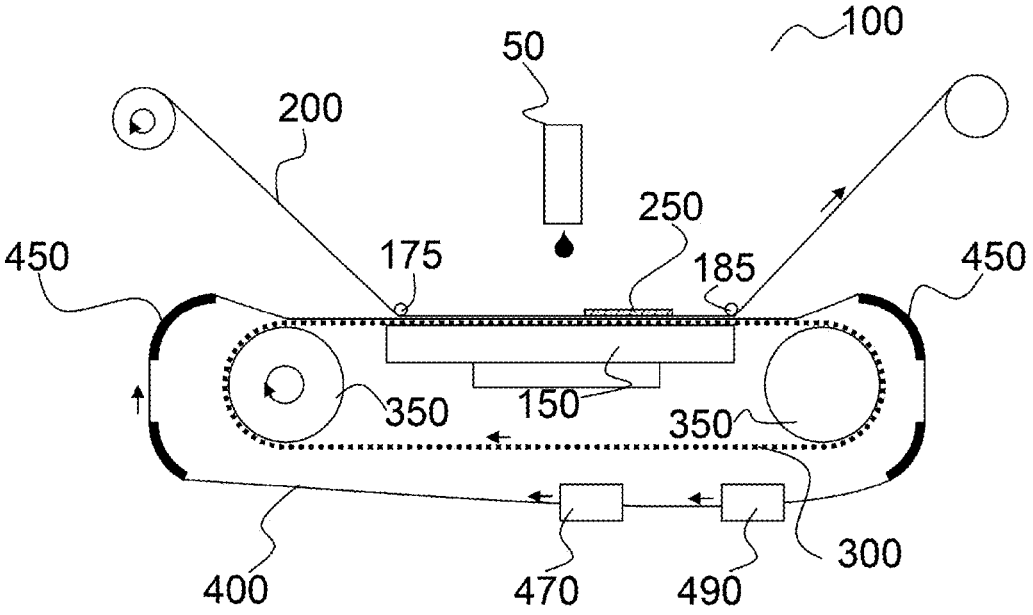
FIG. 5 shows pulleys as sliding supports where over the second conveyor belt (400, $CB_2$) is conveyed. The second conveyor belt (400, $CB_2$) comprises a sticky layer, which is not shown in the drawing and which is treated in a treatment station comprising a wash station (470) and restoration station (490) for applying a new sticky layer or restoration of a sticky zone on the second conveyor belt (400, $CB_2$).

The hide (402) may also be a part of a hide such as butt (104), belly (504), neck (304), leg (404), shoulder (204) (FIG. 3). The hide (402) may also be full grain leather, top grain leather or split leather. A dictionary of leather specific vocabulary can be found on www.leather-dictionary.com.

The inkjet printing method of the present invention and any of its preferred embodiments are preferably comprised in manufacturing of natural leather articles.

Crease-sensitive print receivers are print receivers grouped together which easily crease, wrinkle, crumple and/or rumple when handled in a printing device which affects badly the print quality of the marked pattern on the print receiver (200). Preferred crease-sensitive print receivers, advantageous for the present invention to mark a pattern are flexible films with a thickness below 100 micrometers, preferably below 50 micrometers or flexible sheets with a thickness below 100 micrometers, preferably below 50 micrometers. Examples and preferred embodiments of such flexible films and sheets are textile, dye sublimation transfer paper, transfer foil, shrink foil, stretch wrap, plastic wrap, cling wrap, food wrap aluminium foil wax paper, cotton, cloth, flag fabrics, knitted polyester fabrics and flexible material comprising a network of natural or artificial fibres (yarn or thread). The opposite word for crease-sensitive is sometimes called crease-resistant, wrinkleproof or wrinkle-resistant.

In a preferred embodiment the printing device comprises a flattener in the upstream area to flatten a crease-sensitive print receiver (200), such as textile, before marking the crease-sensitive print receiver (200) to avoid bad print quality on non-flattened portions of such print receivers. The bad print quality is for example caused because the difference between the marking device, such as an inkjet print head (50), and the print receiver (200) gives a different result of marking.

Print quality of marked patterns can easily be determined and compared. More information about print quality is disclosed in Pedersen Marius: "*Image quality metrics for the evaluation of printing quality*", *Image Quality and System Performance VIII*, edited by Susan P. Farnand, Frans Gaykema, *Proc. of SPIE-IS&T Electronic Imaging, SPIE Vol.* 7867, 786702-© 2011 SPIE-IS&T CCC code: 0277-786X/11/$18 doi: 10.1117/12.876472 and tools for inspection of print quality can be performed by hardware tools and software tools of imageXpert™ (www.imagexpert.com).

Brittle print receivers are print receivers grouped together which are brittle, splintery, crackable and/or easily breakable. The stress-factor while conveying and/or marking these print receivers and/or drying the pattern marked on these print receivers becomes less in this present invention than a solution without the second conveyor belt (400, $CB_2$) from the present invention. Examples of such print receivers and preferred embodiments are glass, cement panels, fiber cement panels, ceramics or coated resin impregnated paper.

If the print receiver (200) is a resin impregnated paper, the paper is provided with an amount of resin, more particularly is soaked in resin and/or is impregnated with resin. The resin is preferably a thermosetting resin and more preferably a melamine based resin and most preferably a melamine formaldehyde based resin with formaldehyde to melamine ratio of 1.4 to 2. Other thermosetting resins may be ureum-formaldehyde based resins and phenol-formaldehyde based resins. Such melamine impregnated paper, which is very brittle, is for example used in the manufacturing of decorative laminates. The printing method and printing device of the present invention is preferably part of the manufacturing of decorative workpieces and a decorative laminate manufacturing line.

In a preferred embodiment the decorative laminates are selected from the group consisting of kitchen panels, flooring panels, furniture panels, ceiling panels and wall panels. The decorative laminates may be rigid sheets but may also be rolls of a flexible substrate. The manufacturing of a decorative laminate comprises the following step: printing a first decorative layer by the present invented printing device and delivering the printed decorative layer to a laminate heating press where it is heat pressed, preferably by a Direct Pressure Laminate process, into a decorative laminate.

Preferably the printing method of the present invention is performed with the thermosetting resin impregnated paper substrate as print receiver (200) or on an ink acceptance layer present on the surface of the thermosetting resin impregnated paper substrate as print receiver (200).

Edge curl sensitive print receiver (200) are print receivers grouped together which are sensitive to curl one or more of their edges. Due to internal tensions inside the print receiver (200) the edges or curling up or down so such print receivers are mostly not flat to mount in a printing device. They have to be flattened first before marking. Sometimes the internal tensions are so high that even vacuum power cannot hold the edges flattened. In an inkjet printing device the uprising edges may cause crashing the print receiver (200) against the head. A good example and preferred embodiment of such edge curl sensitive print receivers is hide leather wherein the tensions internally are different due to the natural product. At the edges the hide leather is mostly also thin which cause easy curling at this edges. In the state of the art these edges are taped against the vacuum conveyor belt whereby no marking can occur on these tapes and/or contaminated with the glue from the tape.

Rough back-side print receivers are print receivers grouped together which have a rough back-side. By roughness is meant the surface roughness. The back-side is the opposite of the front-side whereon the pattern is marked. Due to this roughness the sucking of such print receivers on a vacuum conveyor belt is very difficult to handle. The roughness at the back-side makes it possible that vacuum power loses air between this roughness and the edges of these print receivers. This results in edge curling and/or bad suction of these print receivers. By using the second conveyor belt (400, $CB_2$) from the present invention; especially when it is a sticky conveyor belt; the conveying of these rough back-side print receivers is handled much easier than directly the print receivers on the conventional vacuum conveyor belt. On a Jeti Titan™; manufactured by Agfa Graphics there were troubles for mounting a hide leather because of insufficient suction of vacuum power in this printing device and because of difficulties for avoiding wrinkles which may crash against a print head (50) of this printing device by transforming Jeti Titan™ to the present invention this issue may be solved.

In the state-of-the-art the amount and/or sizes of the apertures in the vacuum conveyor belt are adapted to handle these rough back-side print receivers but this makes the printing device more print receiver (200) dependent. This dependency is not an economically benefit because more than one printing device have to be available for a printing device operator.

The average roughness $R_a$ of these rough back-side print receivers is between 2 μm to 300 μm or between 5 μm to 100 μm or between 8 μm until 75 μm. Examples and preferred embodiments of rough back-side print receivers are textured packaging material; semiconductor wafers and leather. $R_a$ is the arithmetic average of the absolute values of the roughness profile ordinates, also known as Arithmetic Average (AA), Center Line Average (CLA). The average roughness is the area between the roughness profile and its mean line, or the integral of the absolute value of the roughness profile height over the evaluation length.

It is found that the present invention is advantageous, especially when the second conveyor belt (400, $CB_2$) is a sticky conveyor belt when the printed print receiver (200) becomes crease-sensitive; brittle or edge-curl sensitive when handled on the second conveyor belt (400, $CB_2$). For example ink on a print receiver (200) may cause edge curling which is prevented by the present invention. The print receiver (200) may be a heat-sensitive print receiver (200). Heat-sensitive print receivers are print receivers grouped together which deform when a heat is applied on its surface. In some printing technologies heat is a result from the print process but mainly the heat is a result of drying ink on the print receiver (200). By the heat the heat-sensitive print receiver (200) becomes a crease-sensitive print receiver (200). The heat when such print receivers deform is mostly above 50° C.

A preferred embodiment of the present invention is that the printing device is a textile printing device; more preferably a digital textile printing device; most preferably an inkjet textile printing device and the print receiver (200) is textile. Textile is a crease-sensitive print receiver (200) and permeable print receiver (200).

Another preferred embodiment of the present invention is that the printing device is a leather printing device; more preferably a digital leather printing device; most preferably an inkjet leather printing device. In such printing devices is the print receiver (200) leather which is genuine leather, also called natural leather, and thus not imitation, also called fake leather, which have been made to resemble genuine leather. The great bulk of these imitations are rubber or plastic-coated fabrics. It is unlawful to use terms connoting leather to describe imitations. Leather is an animal skin which has been preserved and dressed for use. Leather is an edge curl sensitive print receiver (200) and rough back-side print receiver (200).

The leather as print receiver (200) is preferably a hide leather coming of several animals; preferably selected from the group comprising: cow; goat; horse; alligator; snake; crocodile; sheep or calf.

In the state-of-the-art leather; as print receiver (200); are taped at the edges of leather to prevent the loss of vacuum power and to hold down the leather in the printing device. But this asks a lot of mounting time which is economically not beneficial, which can now by the present invention be overcome.

Another preferred embodiment of the present invention is that the printing device is a plastic foil printing device; more preferably a digital plastic foil printing device most preferably an inkjet plastic foil printing device which prints only on plastic foil. Plastic foil is a typical crease-sensitive print receiver (200). The thickness of a plastic foil is preferably between 20 and 200 μm, more preferably between 50 and 100 μm and most preferably between 60 to 80 μm. In a preferred embodiment the plastic foil is suitable for making plastic bags. Plastic foils are generally heat-sensitive substrates. Plastic foil may comprise polyvinyl chloride (PVC), polyethylene (PE), low density polyethylene (LDPE), polyvinylidene chloride (PVdC).

The handling of plastic foil on a vacuum conveyor belt directly is difficult due to uncontrolled adhering of the plastic foils against the vacuum support and due to easy crinkle of the plastic foil while conveying and/or heating the surface of the plastic foil, for example in a hot print area ($A_{print}$) and/or hot drying zone This crinkle effect on the plastic foil cannot be hold down and hold flat on current vacuum supports so the plastic foil may for example touch against a print head (50) from the printing device. Also crinkled plastic foil is not acceptable for sale for example by bad print quality if the plastic foil was not flat while printed. In the state-of-the-art extra guiding means are implemented in the printing device to hold down and flat the plastic foil. The holding down of plastic foils is in the present invention guaranteed.

The inkjet printing method from the present invention may comprise one or more of the following steps: print receiver (200) pre-treatment, drying, curing, fixing and optionally post treatment.

The pre-treatment of the print receiver (200) is a step prior the marking of the print receiver (200) by the inkjet printing method from the present invention. The pre-treatment may comprise one or more of the following: preheating of the receiving print receiver (200) on the second conveyor belt (400, $CB_2$) from the present invention to enhance spreading of the used ink on the receiving print receiver (200) and/or to enhance absorption of the used ink into the receiving print receiver (200); primer pre-treatment for increasing the surface tension of receiving print receiver (200) on the second conveyor belt (400, $CB_2$) in order to improve the wettability of the receiving print receiver (200) by the used jetted ink to mark the receiving print receiver (200); cleaning the receiving print receiver (200), especially fabric from dust and particles on the printed side of the receiving print receiver (200). Print receivers may have loose material on its surface which reduces the final print quality on these print receivers. So a cleaning apparatus, more specific a surface cleaning apparatus improves the print quality drastically, especially when the receiving print receiver (200) is fabric or leather.

Primer pre-treatment may be performed in the gas phase, e.g. with gaseous acids such as hydrochloric acid, sulfuric acid, acetic acid, phosphoric acid and lactic acid, or in the liquid phase by coating the receiving print receiver (200) with a pre-treatment liquid. The pre-treatment liquid may comprise water as a solvent, one or more co-solvents, additives such as surfactants and at least one compound selected from a polyvalent metal salt, an acid and a cationic resin. As an application way of the pre-treatment liquid, any conventionally known methods can be used. Specific examples of an application way include: a roller coating, an ink-jet application, a curtain coating and a spray coating. Preferably the spray coating is a spray application which is, through a combination of high pressure mechanically atomised spray nozzles, applying a controlled and consistent coating to the surface, fully variable in application rates through pressure, flow and variable application speeds.

Corona or plasma treatment may be used as a pre-treatment step by exposing a sheet of a receiving print receiver (200) to corona discharge or plasma treatment for improvement of the adhesion and spreading of the ink by increasing the surface energy of the print receivers. Surface properties of the receiving print receiver (200) may be tuned by using different gases or gas mixtures as print receiver (200) in the corona or plasma treatment. Examples are air, oxygen, nitrogen, carbondioxide, methane, fluorine gas, argon, neon and mixtures thereof. Corona treatment in air is most preferred. Corona or plasma treatment may also be used as post-treatment step by exposing the printed sheet and printed pattern on the receiving print receiver (200).

In a preferred embodiment the printing device may have a surface cleaning apparatus to clean the surface of the print receiver (200), more preferably the print side of the print receiver (200) from dust and lint. The surface cleaning apparatus preferably comprises an adhesive surface in which the adhesive surface is arranged, in use, to contact a surface to be cleaned. And wherein the adhesive surface comprises an adhesive selected from the group of water soluble adhesive, thermoplastic adhesive, pressure sensitive adhesive and permanent adhesive.

The present invention may be part of a transfer printing method wherein the marked print receiver (200), such as paper, is transferred onto other receivers, such as various synthetic fabrics for example by heat, time and pressure, more preferably the present invention may be part of a dye sublimation method wherein jetted liquid comprising disperse dye marked on the print receiver (200), for example paper, is sublimated and fixed to a fabric by heat between 100 and 300° C. Such a fabric is selected from a group comprising 100% polyester, nylon, acrylic blends of polyester and synthetic blends of polyester.

The First Conveyor Belt (300, $CB_1$)

A conveyor belt is a belt for conveying a load, such as a print receiver (200), between a pair of pulleys where on the conveyor belt is wrapped. A conveyor belt has a support side whereon the print load is conveyed and a back side which is in contact with the pair of pulleys. There is a substantial parallel relationship to the longitudinal axis of these pulleys to convey the conveyor belt straight over these pulleys. These parallel pulleys are also called belt pulleys. The first conveyor belt (300, $CB_1$) may any type of belt, such as timing belts, ribbed belts but preferably the belt is in the present invention a flat belt.

The width of a conveyor belt is the distance of the conveyor belt which is measured in the parallel direction as the pair of pulleys. The width of a conveyor belt is the distance between the edges of the conveyor belt across the conveyor belt parallel to these parallel pulleys.

The length of a conveyor belt is the distance of the conveyor belt which is measured perpendicular to the parallel direction as the pair of pulleys. It defines the length of the loop which is formed by the conveyor belt.

The minimum path of a conveyor belt is the minimum distance that a conveyor belt may conveyed over its pair of pulleys.

The conveying direction of a conveyor belt is the direction of conveying the conveyor belt which is perpendicular to a pair of pulleys whereon the conveyor belt is wrapped or looped. The conveying direction of a conveyor belt defines the path that conveyor belt is following over the wrapped pair of pulleys.

A pulley is a cylinder preferably mounted on a central axis rod. The pulley comprises a pulley cover which comes in contact with the conveyor belt.

A pulley may comprise a belt guider to prevent or minimize swimming of the belt over the pair of pulleys. Swimming of a belt is a phenomenon that moves the pulley left to right or right to left over the pulley perpendicular the conveying direction.

The first conveyor belt (300, $CB_1$) in the present invention which is wrapped around a vacuum table is also called a vacuum belt. The first conveyor belt (300, CB1) comprises therefore a plurality of apertures so a vacuum area ($A_{vacuum}$) is created in the printing device by vacuum power of the vacuum table. Such a vacuum area may comprising a plurality of vacuum sub areas if for example the vacuum table comprises a plurality of vacuum sub chambers. The first conveyor belt (300, $CB_1$) is thus a permeable conveyor belt, more precisely an air-permeable conveyor belt, sometimes called a porous conveyor belt. The bottom of the first conveyor belt (300, $CB_1$); which is the back side; is in contact with the vacuum table and the top of the first conveyor belt (300, $CB_1$); which is the support side; comprises a support zone for the second conveyor belt (400, $CB_2$) in the present invention. The wrapping of a conveyor belt is sometimes in literature called 'looped' around its pulleys. In the present invention is the first conveyor belt (300, $CB_1$) looped around a vacuum table and a pair of pulleys, namely the upstream pulley ($P_{upstream}$) upstream) and the downstream pulley ($P_{downstream}$).

Preferably is the width of the first conveyor belt (300, $CB_1$) between 1 meter and 10 meter, more preferably between 3 meter and 6 meter. Larger the width of the first conveyor belt (300, $CB_1$); larger the width of print receivers that can be marked by a pattern on the printing device of the present invention.

The printing device from the present invention comprises preferably adjustment means to align the longitudinal axis of the pair of pulleys ($P_{upstream}$ and $P_{downstream}$) of the present invention to become parallel to each other. Such adjustment means are well-known in the prior-art. Also the use of more than 2 pulleys where over the first conveyor belt (300, $CB_1$) is wrapped is well-known in the prior-art especially extra pulleys to alter the tensioning of the conveyor belt or to control the conveyor belt to have a straight path over the wrapped pulleys.

A printing device with a vacuum belt to convey a print receiver (200), for marking a pattern on it, is well-known in the state-of-the-art. An example of such printing device is Jeti Tauro™ manufactured by Agfa Graphics™.

Preferably the first conveyor belt (300, $CB_1$) from the present invention has two or more layers of materials wherein an under layer provides linear strength and shape, also called the carcass and an upper layer called the cover or the support side. The carcass is preferably a woven fabric web and more preferably a woven fabric web of polyester, nylon, glass fabric or cotton. The material of the cover comprises preferably various rubber and more preferably plastic compounds and most preferably thermoplastic polymer resins. But also other exotic materials for the cover can be used such as silicone or gum rubber when traction is essential. An example of a multi-layered first conveyor belt (300, $CB_1$) for a general belt conveyor system wherein the cover having a gel coating is disclosed in US 20090098385 A1 (FORBO SIEBLING GMBH). The cover of the first conveyor belt (300, $CB_1$) is in a preferred embodiment of the present invention the side which is supporting the second conveyor belt (400, $CB_2$) in a vacuum area ($A_{vacuum}$) of the printing device. The carcass of the first conveyor belt (300, $CB_1$) is in a preferred embodiment of the present invention the side which is in contact with the pair of pulleys from the present invention. The carcass is in the present invention preferably urethane impregnated to minimize the noise of conveying and rubbing the first conveyor belt (300, $CB_1$) over the pair of pulleys and over the vacuum table.

Preferably the first conveyor belt (300, $CB_1$) from the present invention comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethane (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

In a preferred embodiment is the carcass at the back-side of the first conveyor belt (300, $CB_1$) selected from the group comprising woven fabric and knitted fabric. The knitted fabric is preferably selected from the group comprising weft-knitted fabric and warp-knitted fabric, more preferably the knitted fabric is warp-knitted fabric. The support-side (top-side, cover) of the first conveyor belt (300, $CB_1$) comprises preferably a thermoplastic polymer resin coated on the rough layer. The support area of the present invention is preferably abraded engineering plastic composition or comprises polyethylene terephthalate (PET), polyamide (PA), high-density polyethylene (HDPE), polytetrafluoroethylene (PTFE), polyoxymethylene (POM) and/or Polyaryletherketone (PAEK).

The woven fabric is preferably selected from the group comprising plain-weave fabric, twill-weave fabric and satin weave fabric, more preferably woven fabric is a plain-weave fabric.

Woven fabrics are made up of a weft—the yarn going across the width of the fabric—and a warp—the yarn going down the length of the loom. The side of the fabric where the wefts are double-backed to form a non-fraying edge is called the selvedge. Plain-weave fabric the warp and weft are aligned so that they form a simple criss-cross pattern. Plain-weave is strong and hardwearing. In twill-weave fabric the crossings of weft and warp are offset to give a diagonal pattern on the fabric surface. It's strong, drapes well. In satin-weave fabric there is a complex arrangement of warp and weft threads, which allows longer float threads either across the warp or the weft. The long floats mean the light falling on the yarn doesn't scatter and break up, like on a plain-weave fabric. Weft-knitted fabric is made by looping together long lengths of yarn. It can be made by hand or machine. The yarn runs in rows across the fabric. If a stitch is dropped it will ladder down the length of the fabric. In warp-knitted fabric the loops interlock vertically along the length of the fabric. Warp knits are slightly stretchy and do not ladder.

In a preferred embodiment is the carcass at the back-side of the first conveyor belt (300, $CB_1$) impregnated by polyurethane, more preferably thermoplastic polyurethane (TPU) due to its high wear resistance properties. TPU has also the advantage to be non-porous and chemically inert material, superior cut resistance, tear resistance and abrasion resistance. For the same reasons is in a preferred embodiment the first conveyor belt (300, $CB_1$) a coated woven fabric or coated knitted fabric which is coated by thermoplastic polyurethane.

The top surface of the first conveyor belt (300, $CB_1$) (thus the cover whereon the second conveyor belt (400, $CB_2$) from the present invention is carried) comprises preferable hard urethane with a preferred thickness (measured from top surface to bottom surface) between 0.2 to 2.5 mm. The total thickness (measured from top surface to bottom surface) of the first conveyor belt (300, $CB_1$) is preferably between 1.2 to 7 mm. The top-surface is preferably high resistance to solvents so the inkjet printing device is useful in an industrial printing and/or manufacturing environment. This makes the first conveyor belt (300, $CB_1$) strong to carry heavy print-receivers but also have a strong tear strength (between 100 and 300 N/mm); a high maximum operational temperature (between 50 and 90° C.); a shore hardness of the top surface between 80 and 120 Shore A); a light weight (for easy manufacturing the inkjet printing device) between 1.8 and 4 kg/m2.

The first conveyor belt (300, $CB_1$) may comprise a thermoplastic middle layer for easy looping around the pair of pulleys from the present invention.

The thickness of the first conveyor belt (300, $CB_1$) is preferably between 1 mm and 5 mm; more preferably between 1.5 mm and 3.5 mm. The thickness of the first conveyor belt (300, $CB_1$) is chosen to carry the print receivers but especially for the preferred print receivers of the present invention is a thickness between 2 mm and 3 mm preferred.

The pitch line of the first conveyor belt (300, $CB_1$) is preferably below one third of the thickness of the first conveyor belt (300, $CB_1$), more preferably below one fifth of the thickness of the first conveyor belt (300, $CB_1$), measured from the back-side of the first conveyor belt (300, $CB_1$), which is the side in contact of its wrapped pulleys.

The pitch line of the first conveyor belt (300, $CB_1$) is preferably between 0 and 2 mm; more preferably between 0 and 1 mm and most preferably between 0.1 and 0.8 mm. These distances are measured from the back-side of the first conveyor belt (300, $CB_1$), which is the side in contact of its wrapped pulleys.

Such a pitch line of the first conveyor belt (300, $CB_1$) is important in the present invention to have a high marking accuracy; especially in printing device with a high print resolution and inkjet printing devices comprising inkjet heads which are capable of jetting small droplets less than 12 pL. The pitch line is the plane within a conveyor belt which undergoes neither stretching nor compression when the belt rounds the pulley, i.e., the neutral plane of the belt structure. Conveyor belts, which are usually made comparatively thick and stiff in order to withstand the loads to be carried thereby, tend to develop stresses in their outer portions as they flex to pass around pulleys or rollers. Because their inner surfaces which contact the pulleys or rollers are substantially non-compressible, the belt pivots about the point of contact of the inner surface with the pulley as it flexes to pass around the pulley. Thence the outer surface must stretch by an amount which is dependent upon the thickness of the belt and the degree of curvature of the belt. That is another reason why the pitch line is so important in a printing device.

The weight of the first conveyor belt (300, $CB_1$) for easily conveying and mounting the first conveyor belt (300, $CB_1$) while manufacturing the printing device of the present invention is preferably between 1 $kg/m^2$ and 5 $kg/m^2$; more preferably between 2 $kg/m^2$ and 3 $kg/m^2$.

The shore hardness of the top surface of the first conveyor belt (300, $CB_1$); whereon the second conveyor belt (400, $CB_2$) is supported in the present invention; is preferably higher than 60 Shore A; more preferably higher than 90 Shore A. This hardness is important for the marking accuracy on the print receiver (200) (Shore A is measured according to the standard ISO 7619-1).

Preferably the first conveyor belt (300, $CB_1$) from the present invention is an endless first conveyor belt (300, $CB_1$). Examples and figures for manufacturing an endless multi-layered first conveyor belt (300, $CB_1$) for a general belt conveyor system are disclosed in EP 1669635 (FORBO SIEBLING GMBH). A non-endless conveyor belt may cause a height difference which has to be avoided in printing device because this influences the print quality of the marked pattern on the print receiver (200) badly.

To have a better sucking the second conveyor belt (400, $CB_2$) from the present invention together with the first conveyor belt (300, $CB_1$) on the vacuum table from the present invention the first conveyor belt (300, $CB_1$) has than a plurality of holes so that the air can be directed and sucked through the first conveyor belt (300, $CB_1$). The plurality of these holes may be small in size, preferably from 0.3 to 10 mm in diameter, more preferably from 0.4 to 5 mm in diameter, most preferably from 0.5 to 2 mm in diameter and preferably spaced evenly apart on the first conveyor belt (300, $CB_1$) preferably 3 mm to 50 mm apart, more preferably from 4 to 30 mm apart and most preferably from 5 to 15 mm apart to enable the creation of uniform vacuum pressure that sucks the second conveyor belt (400, $CB_2$) together with the first conveyor belt (300, $CB_1$). Smaller the apertures in the first conveyor belt (300, $CB_1$), higher the vacuum pressure at the top of the first conveyor belt (300, $CB_1$).

It is found that in a first conveyor belt (300, $CB_1$) which comprises a carcass in glass fabric or woven fabric and holes smaller than 3 mm gives a superb vacuum to suck down the second conveyor belt (400, $CB_2$). The advantage of glass or woven fabric web versus other fabric web, as carcass in a first conveyor belt (300, $CB_1$), makes it easier to drill small holes smaller than 3 mm in diameter without remaining fibres at the edges of the holes after drilling. If fibres remain at the edges of the holes, the vacuum pressure is influenced badly to suck down the second conveyor belt (400, $CB_2$).

The first conveyor belt (300, $CB_1$) is tensioned between the pair of pulleys from the present invention. The tensioning may be caused by aligning the parallel pulleys and/or widen the distance between the longitudinal axes of the pair of pulleys in the present invention. This tensioning of the first conveyor belt (300, $CB_1$) is important for heavy print receivers and for heaving correct print alignment of the marked pattern.

The mounting of the first conveyor belt (300, $CB_1$) in the printing device asks for a demanding procedure wherein the tensioning over the pair of pulleys is measured and controlled for example by widening the longitudinal axes from each other. Both edges (left and right) of the conveyor belt are also controlled to calculate the swim and/or drift of the conveyor belt over the pair of pulleys. By adapting the tensioning the swim and/or drift is controlled. The stability of the drift and/or swim and tensioning of the first conveyor belt (300, $CB_1$) is subsequently controlled for more than one hour (=relaxation phase). If some deformations in the first conveyor belt (300, $CB_1$) are seen in this demanding procedure; a wait time of twelve hours are needed for relaxation of the first conveyor belt (300, $CB_1$) where after the whole procedure had to be restarted.

The effective tensile force on the first conveyor belt (300, $CB_1$) has to be at least equal or even greater than the required force for slippage-free conveying.

The tensioning of the first conveyor belt (300, $CB_1$) may be controlled by attaching an extra pulley whereon the first conveyor belt (300, $CB_1$) is wrapped and which may be angled versus the longitudinal axes of the pair of pulleys. Such an extra pulley is sometimes called an alignment pulley or an align roller.

The conveying of the first conveyor belt (300, $CB_1$) is preferably driven by a motor; more preferably an electric stepper motor; to produce a torque to one of its pulley from the pair of pulleys so by friction on the first conveyor belt (300, $CB_1$) and the powered pulley the print receiver (200) and second conveyor belt (400, $CB_2$) from the present invention is conveyed in a conveying direction. The use of an electric stepper motor makes the transport of a print receiver (200) more controllable e.g. to change the speed of conveying and move the load on the vacuum belt in successive distance movements. An example of a conveying belt with an electric stepper motor is described for the media transport of a wide-format printer in EP 1235690 (ENCAD INC). A preferred embodiment comprises a system for conveying of the first conveyor belt (300, $CB_1$) with successive distance movements; also called discrete step increments to transport the print receiver (200) and second conveyor belt (400, $CB_2$).

Another way of conveying the first conveyor belt (300, $CB_1$) is by a belt step conveyor system with high accurate position capabilities due to a moving belt gripper mounted on a linear movement system to convey the first conveyor belt (300, $CB_1$) in successive distance movements while the moving belt gripper engaged the first conveying belt and the moving belt gripper is moved from a home position to an end position by the linear movement system. The first conveyor belt (300, $CB_1$) is stagnated by the engaging of a stagnating belt gripper while the moving belt gripper moves back to its home position else the stagnating belt gripper has released the conveyor belt. An example of such conveyor system is disclosed in WO2014184226 (AGFA GRAPHICS).

Any of a variety of encoder mechanisms can be employed for controlling linefeed distances while conveying the first conveyor belt (300, $CB_1$). Typically, a rotary encoder is connected to a belt drive roller; belonging to the pair of pulleys. The information provided by the encoder is processed by the printing device to control the linefeed distance.

The printing device may comprise multiple conveyor belts as the first conveyor belt (300, $CB_1$) for example with a different amount of apertures to create different vacuum force.

The Second Conveyor Belt (400, $CB_2$)

The second conveyor belt (400, $CB_2$) in the present invention which is wrapped around the first conveyor belt (300, $CB_1$) has the function of supporting a print receiver (200) in the present invention. The second conveyor belt (400, $CB_2$) is actually looped around the first conveyor belt (300, $CB_1$) and in the same direction of the first conveyor belt (300, $CB_1$). The second conveyor belt (400, $CB_2$) is also wrapped around a pair of sliding supports which are substantially parallel to each other. The sliding supports are also substantially parallel to the pair of pulleys where around the first conveyor belt (300, $CB_1$) from the present invention is wrapped. In a preferred embodiment of the present invention is a sliding support (450), from the pair of sliding supports, part from a pulley, more preferably the pair of sliding supports is another pair of pulleys, thus not the pair of pulleys where over the first conveyor belt (300, $CB_1$) is wrapped. Such pulley of the another pair of pulleys; which comprises a sliding support (450) from the present invention; may be unrotatable but preferably rotatable around its longitudinal axis. The rotation of the pulley is in the present invention preferably performed by friction of the second conveyor belt (400, $CB_2$) while transporting by the first conveyor belt (300, $CB_1$). The rotation of the pulley may be driven by a motor for example for easy handling the second conveyor belt (400, CB2) on the first conveyor belt (300, CB1) or lightly controlling the transport direction and movement of the second conveyor belt (400, CB2).

In order to better understand the invention: the pair of sliding supports ($S_{upstream}$ and $S_{downstream}$) is mounted outside the first conveyor belt (300, $CB_1$), so the first conveyor belt (300, $CB_1$) is not wrapped around the pair of sliding supports and the pair of sliding supports are no part of the pair of pulleys whereon the first conveyor belt (300, $CB_1$) from the present invention is wrapped and so the first conveyor belt (300, $CB_1$) is not in contact with the pair of sliding supports.

The second conveyor belt (400, $CB_2$) is at its back-side in contact, possibly through an air-flow of an air-cushion system, comprised in a sliding support (450), with these pair of sliding supports; which may be another pair of pulleys. The side from a sliding support (450) whereon the second conveyor belt (400, $CB_2$) from the present invention is supported is called the support surface or support side of the sliding support (450).

The second conveyor belt (400, $CB_2$) may be wrapped also around an extra pulley or extra plurality of pulleys, such as dancer rollers, which are not in contact with the first conveyor belt (300, $CB_1$) and constructed outside the first conveyor belt (300, $CB_1$).

The second conveyor belt (400, $CB_2$) may be flattened towards the first conveyor belt (300, $CB_1$) by a flattener to flatten the second conveyor belt (400, $CB_2$) without creases on the first conveyor belt (300, $CB_1$). The flattener, also called wrinkle removing device, may comprise a slipping roll guider and/or slat expander roll and/or bowed spreader roll and/or any type of roll to remove wrinkles, available in the state-of-the-art. If the print receiver (200) is a web material or a crease sensitive print receiver (200), such as textile, than the flattener may also be used for this web material or crease sensitive print receiver (200).

The flattener may comprise a break to slow down the second conveyor belt ($CB_2$) to come on the first conveyor belt (300, $CB_1$). The advantage of such a break is that the path of the second conveyor belt (400, $CB_2$) is controlled on web swim and position on the upstream sliding support (450, $S_{upstream}$).

In a preferred embodiment the upstream sliding support (450, $S_{upstream}$) and/or the upstream area ($A_{upstream}$) may comprise a break to slow down and reducing the speed of the second conveyor belt (400, $CB_2$) to come on the first conveyor belt (300, $CB_1$). The break gives the advantage that the path of the second conveyor belt (400, $CB_2$) is controlled on web swim and position on the upstream sliding support (450, $S_{upstream}$). Less efficient but also a preferred embodiment is that the break is positioned in the downstream area ($A_{downstream}$) and/or below the vacuum table between the downstream sliding support (450, $S_{downstream}$) to the upstream sliding support (450, $S_{upstream}$).

The break maybe a roll guider which is in contact with the top surface of the second conveyor belt (400, $CB_2$), which is the side whereon the print receiver (200) is carried. If the second conveyor belt (400, $CB_2$) is a sticky conveyor belt and the upstream sliding support (450, $S_{upstream}$) is comprised in a pulley, rotatable around its longitudinal axis, the break is preferably attached to the pulley so the break is not in contact with the top surface of the second conveyor belt (400, $CB_2$), such as drum brakes and/or disk brakes.

Due to the rotation of the second conveyor belt (400, $CB_2$); which is in contact by suction in a vacuum area ($A_{vacuum}$) from the first conveyor belt (300, $CB_1$) while rotating the first conveyor belt (300, $CB_1$) around its pair of pulleys ($P_{upstream}$, $P_{downstream}$) from the present invention; a print receiver (200) on the second conveyor belt (400, $CB_2$) is conveyed in the printing device between a sliding support (450), also called the upstream sliding support (450, $S_{upstream}$) and another sliding support (450), also called the downstream sliding support (450, $S_{downstream}$). The pair of sliding supports; where over the second conveyor belt (400, CB2) is wrapped; includes the upstream sliding support (450, $S_{upstream}$) and the downstream sliding support (450, S downstream). Analogue the pair of pulleys, where over the first conveyor belt (300, CB1) is wrapped, includes an upstream pulley ($P_{upstream}$) and downstream pulley (P downstream) downstream) wherein between the second conveyor belt (400, CB2) is conveyed and thus also the print receiver (200). The marking of the print receiver (200) is performed between the upstream sliding support (450, $S_{upstream}$) and the downstream sliding support (450, $S_{downstream}$).

The conveying direction of the first conveyor belt (300, $CB_1$), print receiver (200) and second conveyor belt (400, $CB_2$) is determined from upstream zone to downstream zone, from the upstream sliding support (450, $S_{upstream}$) to the downstream sliding support (450, $S_{downstream}$) and from the upstream pulley ($P_{upstream}$) to the downstream pulley ($P_{downstream}$).

The width of the second conveyor belt (400, $CB_2$) is the distance of the second conveyor belt (400, $CB_2$) which is measured in the parallel direction as the pair of sliding supports. The width of the second conveyor belt (400, $CB_2$) is the distance between the edges of the second conveyor belt (400, $CB_2$) across the second conveyor belt (400, $CB_2$) parallel to these parallel sliding supports.

The length of the second conveyor belt (400, $CB_2$) is the distance of the second conveyor belt (400, $CB_2$) which is measured perpendicular to the parallel direction as the pair of sliding supports. It defines the length of the loop which is formed by the second conveyor belt (400, $CB_2$).

The conveying direction of the second conveyor belt (400, $CB_2$) is the direction of conveying the second conveyor belt (400, $CB_2$) which is perpendicular to a pair of sliding supports whereon the second conveyor belt (400, $CB_2$) is wrapped or looped. The conveying direction of the second conveyor belt (400, $CB_2$) defines the path that conveyor belt is following over the wrapped pair of sliding supports.

A sliding support (450) may comprise a belt guider to prevent or minimize swimming of the second conveyor belt (400, $CB_2$) over the pair of sliding supports which is left-to-right/right-to-left movement of the second conveyor belt (400, $CB_2$) in a direction perpendicular the conveying direction of the second conveyor belt (400, $CB_2$).

The advantage of using a second conveyor belt (400, $CB_2$), especially for crease-sensitive print receiver (200); heat-sensitive print receivers; brittle print receiver (200) and edge-curl sensitive print receiver (200), rough back-side print receiver (200), is the possibility to switch between a well-known printing device with a vacuum belt wherein more easily handling print receivers are conveyed by the vacuum belt in the printing device to the printing device from the present invention with its wrapped vacuum belt by the second conveyor belt (400, $CB_2$) from the present invention wherein difficult handling print receivers are conveyed by the second conveyor belt (400, $CB_2$). The bottom of the second conveyor belt (400, $CB_2$); which is the back side; is in contact with the first conveyor belt (300, $CB_1$) and the top of the second conveyor belt (400, $CB_2$); which is the support side, comprises a support zone of the print receiver (200) in the present invention. The curvature of a supporting surface whereon the second conveyor belt (400, $CB_2$) is wrapped is in rotational direction of the second conveyor belt (400, $CB_2$) from the present invention.

The printing device from the present invention comprises preferably adjustment means to align the longitudinal axis of the pair of sliding supports of the present invention to become parallel to each other.

The printing device may comprise multiple conveyor belts as the second conveyor belt (400, $CB_2$) for example and as preferred embodiment with different glue to create different glue zones depending on the print receivers carried on these multiple conveyor belts as the second conveyor belt (400, $CB_2$). The multiple conveyor belts are then also wrapped around the pair of sliding supports from the present invention.

In a preferred embodiment the second conveyor belt (400, $CB_2$) comprises a ruler and/or indexer which may be used for measuring the movement and/or speed of the second conveyor belt (400, $CB_2$) for example by a sensor, such as an encoder and an optical linear encoder, or measuring the sizes of the print receiver (200). The signals from the sensor, such as an optical linear encoder, after reading the ruler and/or indexer determines in a control system the position of the second conveyor belt (400, $CB_2$) or the speed of the second conveyor belt (400, $CB_2$) and indirectly the position of the print receiver (200) carried on the second conveyor belt (400, $CB_2$). The encoder may have a digital resolution between 0.01 micrometer and 250 micrometer, more preferably a digital resolution between 0.01 and 50 micrometer and most preferably a digital resolution between 0.01 and 10 micrometer. Especially when the second conveyor belt (400, CB2) moves in a successive distance movements such small digital resolutions are important to calculate from the encoder signals the real successive distance movements. The ruler and/or indexer may be comprised on the support side of the second conveyor belt (400, $CB_2$); which is the side in connection with the print receiver (200) and/or on the back side of the second conveyor belt (400, $CB_2$); which is the side in connection with the first conveyor belt (300, $CB_1$).

A sliding support (450) from the pair of sliding supports may comprise an air cushion system to lower the slip of the second conveyor belt (400, $CB_2$) from the present invention. This is also called an air cushion sliding support (450) and if the sliding support (450) is a pulley, it is called an air cushion pulley.

By providing air in an air chamber at the back-side of the sliding support (450), which is internally if the sliding support (450) is a pulley, the air arrives through a plurality of holes out the support surface of the perforated sliding support (450) so an air cushion effect on the second conveyor belt (400, $CB_2$) from the present invention is achieved. The air flow rate through the plurality of holes may be controlled. The plurality of holes may be small in size, preferably from 0.3 to 2 mm in diameter, more preferably from 0.4 to 5 mm in diameter, most preferably from 0.5 to 10 mm in diameter. The plurality of holes may be spaced evenly apart on the surface of the air cushion sliding support (450), preferably 3 mm to 50 mm apart, more preferably from 4 to 30 mm apart and most preferably from 5 to 15 mm apart to have an advantageous effect by lower the slip on the air cushion sliding support (450) and thus the stability of the second conveyor belt (400, $CB_2$). The second conveyor belt (400, $CB_2$) is then carried on a film of air around the air cushion sliding support (450) which results in a contact-free passing of the conveyor belt over the sliding support (450). Preferably the surface of the air cushion sliding support (450) is divided in logical zones, also called air cushion zones. An air cushion zone comprises a part of the plurality of holes. The air flow in each air cushion zone can be controlled separately e.g. by changing the air flows the conveying path of the second conveyor belt (400, $CB_2$) may be controlled. For each cushion zone the air cushion sliding support (450) may comprise an air chamber at the back-side of the sliding support (450) which is internally in the sliding support (450) if it is a pulley.

The supporting surface of a sliding support (450) from the present invention may be an engineering plastic or comprise PE (polyethene or polyethylene), UHMWPE (Ultra-high-molecular-weight polyethylene), polyethylene terephthalate (PET), polyamide (PA), high-density polyethylene (HDPE), polytetrafluoroethylene (PTFE), polyoxymethylene (POM) and/or Polyaryletherketone (PAEK) which are convenient and in an easy manner to allow low friction on the support surface of the sliding support (450). A sliding support (450) is also called a gliding support.

The supporting surface of a sliding support (450) from the present invention may comprise metal, steel, stainless steel, woven metal. Any type of metal supporting surface may be used if the friction with the second conveyor belt (400, CB2) from the present invention is low to have long life-time of the second conveyor belt (400, $CB_2$).

The supporting surface of a sliding support (450) may comprise a plurality of raised marks at. The raised marks form preferably a textured surface with reduced friction so more preferably the raised marks are elongated in the conveying direction so the gliding of the second conveyor belt (400, $CB_2$) is improved. The sliding support (450) is preferably a curved diamond plate, such as the Rigidized Metals 5WL® from Rigidized Metals Corporation® with its woven fabrik look, wherein the raised marks are elongated in the conveying direction.

The supporting surface of a sliding support (450) may be coated with polyurethane, more preferably thermoplastic polyurethane (TPU) due to its high wear resistance properties. TPU has also the advantage to be non-porous and chemically inert material, superior cut resistance, tear resistance and abrasion resistance. Also another coatings such as Teflon™, may be used if it improves the sliding of the second conveyor belt (400, $CB_2$) over the sliding supports.

In a preferred embodiment of the present invention the second conveyor belt (400, $CB_2$) is hanging, more preferably freely hanging, between the downstream sliding support (450, $S_{downstream}$) and the upstream sliding support (450, $S_{upstream}$). The tension between the downstream and upstream sliding support (450, $S_{upstream}$) is preferably lower than the tension on the first conveyor belt (300, $CB_1$) from the present invention and more preferably untensioned between the downstream and upstream sliding support (450, $S_{upstream}$). For clarification the tension means in here the force on the conveyor belt along the conveying direction, also called the conveying-direction-tension. An extra advantage of a lower tensioning or untensioned conveying of the second conveyor belt (400, $CB_2$) between the downstream and upstream sliding support (450, $S_{upstream}$) is that the life-time of the second conveyor belt (400, $CB_2$) is enlarged.

The total sum of tension inside the second conveyor belt (400, $CB_2$) is preferably lower than the total sum of tension inside the first conveyor belt (300, $CB_1$) especially while printing.

If the tensioning of the second conveyor belt (400, $CB_2$) is equal or higher versus the first conveyor belt (300, $CB_1$) it is found that the second conveyor belt (400, $CB_2$) generates easily crinkles and/or unpredicted internal tensions which results in position changes of the print receiver (200) on top of the second conveyor belt (400, $CB_2$). Such position changes reduced the print quality of the printed patterns or may collapse the print receiver (200) against the marking device or dryer from the printing device. Also it makes it harder to apply a second conveyor belt (400, $CB_2$) around the first conveyor belt and the upstream sliding support (450, $S_{upstream}$) and downstream sliding support (450, $S_{downstream}$) so the total sum of tension inside the second conveyor belt (400, $CB_2$) is preferably lower than the total sum of tension inside the first conveyor belt (300, $CB_1$) especially while printing.

Material

To suck the second conveyor belt (400, $CB_2$) better by a vacuum power to the vacuum belt, the second conveyor belt (400, $CB_2$) is preferably an air-impermeable conveyor belt. The material is preferably not crease-sensitive; brittle or edge-curl sensitive and the material has preferably not a back side with an average roughness ($R_a$) higher than 100 μm because these materials are difficult to handle on a vacuum belt.

The material of the second conveyor belt (400, $CB_2$), also called the support of the second conveyor belt (400, $CB_2$), may be transparent or opaque or semi-transparent. The color of the second conveyor belt (400, $CB_2$) may be any color but a black support side from the second conveyor belt (400, $CB_2$) is preferred because it absorb UV light if this is available in the printing device for drying/curing the ink on the print receiver (200) so less stray of the UV light can hit the operator and/or the elements in the printing device such as inkjet print heads.

The material may be a film directly extruded from a thermoplastic polymer or may comprise a fibrous structure comprising synthetic fibers made from for example polyamides, polyester or polyolefins. The material may also comprise metal but it is less preferred due to the possibility of static charging which may influence the print quality of the printed pattern badly or may influence the working of the marking unit from the printing device.

The support of the second conveyor belt (400, $CB_2$) may be transparent or opaque. The advantage of a transparent support of the second conveyor belt (400, $CB_2$) is the possibility to add a mark on the back-side which is in contact with the first conveyor belt (300, $CB_1$). The mark becomes visible at the front-side, which is contact with the print receiver (200), for example for extra control of the position of the print receiver (200) on the second conveyor belt (400, $CB_2$).

In a preferred embodiment the second conveyor belt (400, $CB_2$) comprises marks for indexing the speed and/or position. Such marks are preferably small lines in a direction along the width of the second conveyor belt (400, $CB_2$). These marks may be comprised on the front-side and/or back-side of the second conveyor belt (400, $CB_2$).

The material; also called support; for the second conveyor belt (400, $CB_2$) that is used in the present invention may be resin-coated cellulosic paper, webs having a fibrous structure formed with synthetic fibers and/or webs in which a film is directly extruded from a thermoplastic polymer. The resin-coating of resin-coated cellulosic paper can be rendered non-transparent by the inclusion of opacifying pigments therein. Webs having a fibrous structure formed with synthetic fibers and webs in which a film is directly extruded from a thermoplastic polymer can be rendered non-transparent by the inclusion of opacifying pigments. Furthermore, webs in which a film is directly extruded from a thermoplastic polymer can be also rendered non-transparent by axial stretching-induced microvoid formation resulting from the presence of poorly compatible dispersions of amorphous high polymers with a higher glass transition temperature than the glass transition temperature or melting point of the matrix polymer and/or the crystalline high polymers which melt at a higher temperature than the glass transition temperature or melting point of the matrix polymer and axially stretching the extruded film. Widely used matrix polymers include polyethylene, polypropylene, polystyrene, polyamide and polyester.

The support of the second conveyor belt (400, $CB_2$) is preferably a synthetic paper made from polyester, polyolefin or polyvinylchloride.

The support of the second conveyor belt (400, $CB_2$) is preferably directly extruded from a thermoplastic polymer. The thermoplastic polymer is preferably a polyester. Preferably the support of the second conveyor belt (400, $CB_2$) comprises at least 50 wt. % of a linear polyester.

According to a particularly preferred embodiment, the support of the second conveyor belt (400, $CB_2$) is a non-transparent microvoided axially stretched directly extruded thermoplastic polymer which preferably comprises dispersed therein at least one amorphous high polymer with a higher glass transition temperature than the glass transition temperature of the thermoplastic polymer and/or at least one crystalline high polymer having a melting point which is higher than the glass transition of the thermoplastic polymer. The thermoplastic polymer is preferably a linear polyester and the crystalline polymer is preferably selected from the group consisting of polyethylene, preferably high density polyethylene, polypropylene, preferably isotactic polypropylene, and isotactic poly(4-methyl-1-pentene).

The amorphous polymer is preferably selected from the group consisting of polystyrene, styrene copolymers, styrene-acrylonitrile (SAN)-copolymers, polyacrylates, acrylate-copolymers, poly-methacrylates and methacrylate-copolymers.

According to a particularly preferred embodiment, the support of the second conveyor belt (400, $CB_2$) is a non-transparent microvoided axially stretched directly extruded linear polyester having dispersed therein 5 to 20 wt. % of a styrene-acrylonitrile-block copolymer.

The support of the second conveyor belt (400, $CB_2$) preferably also comprises an opacifying pigment, the opacifying pigment being preferably selected from the group consisting of silica, zinc oxide, zinc sulphide, barium sulphate, calcium carbonate, titanium dioxide, aluminium phosphate and clays. Preferred opacifying pigments are $TiO_2$ pigments. $TiO_2$ particles may be of the anatase or the rutile type. Preferably $TiO_2$ particles of the rutile type are used due to their higher covering power. Because $TiO_2$ is UV-sensitive, radicals may be formed upon exposure to UV radiation, $TiO_2$ particles are typically coated with Al, Si, Zn or Mg oxides. Preferably such $TiO_2$ particles having an $Al_2O_3$ or $Al_2O_3/SiO_2$ coating are used in the present invention.

The support of the second conveyor belt (400, $CB_2$) may further comprise one or more ingredients selected from the group consisting of whitening agents or optical brighteners, UV-absorbers, light stabilizers, antioxidants, flame retardants and colorants.

A particularly preferred support of the second conveyor belt (400, $CB_2$) comprises a continuous phase linear polyester matrix, more preferably a continuous phase linear polyester matrix having dispersed therein a non-crosslinked random SAN-polymer and most preferably a continuous phase linear polyester matrix having dispersed therein a non-crosslinked random-polymer dispersed or dissolved therein at least one ingredient from the group of ingredients consisting of inorganic opacifying pigments, whitening agents, colorants, UV-absorbers, light stabilizers, antioxidants and flame retardants, wherein the film is white, microvoided, non-transparent and axially stretched; the linear polyester matrix has monomer units preferably comprising an aromatic dicarboxylic acid, aliphatic diol and/or aliphatic dicarboxylic acid; the weight ratio of the linear polyester to the non-crosslinked SAN-polymer is in the range of 2.0:1 to 19.0:1; and one of said at least one aromatic dicarboxyate monomer units is isophthalate and said isophthalate is present preferred polyester matrix in a concentration of 10 mole % or less of all the dicarboxylate monomer units in said linear polyester matrix.

To improve the adhesion of the support of the second conveyor belt (400, $CB_2$), one or more subbing layers may be provided. Preferably, the subbing layer comprises a vinylidene chloride containing copolymer, such as for example a vinylidene chloride-methacrylic-itaconic acid copolymer.

To optimize the antistatic properties of the support of the conveyor belt, the subbing layers preferably comprise an antistatic agent. This is important to avoid static charges on the second conveyor belt (400, $CB_2$) which may give rise to bad print quality of the printed pattern on the print receiver (200).

Preferably the width of the second conveyor belt (400, $CB_2$) is between 1 meter and 10 meter, more preferably between 2 meter and 6 meter. Larger the width of the second conveyor belt (400, $CB_2$); larger the width of print receivers that can be marked by a pattern on the printing device of the present invention which is an economic advantage. The width of the second conveyor belt (400, $CB_2$) may be smaller than the first conveyor belt (300, $CB_1$).

More than one conveyor belt as the second conveyor belt (400, $CB_2$) may be wrapped next to each other over the first conveyor belt (300, $CB_1$). They may for example also differ in adherence force. The advantage of multiple conveyor belts as the second conveyor belt (400, $CB_2$), multiple print receivers may be conveyed next to each other; over the conveying width of the first conveyor belt (300, $CB_1$) which is an economically advantage.

The second conveyor belt (400, $CB_2$) may comprise a mark and/or cut-out, preferably at its edges and/or adhesive zones for fast detection of adhesive zones by the operator of the printing device, for measuring the usage time of the second conveyor belt (400, $CB_2$) by capturing the mark and/or cut-out by a capturing device such as a camera or digital microscope, for measuring the speed of the second conveyor belt (400, $CB_2$), for controlling web-swim of the second conveyor belt (400, $CB_2$). Such a mark may be engraved by a laser or printed at the production side of the second conveyor belt (400, $CB_2$). Such cut-out may be cut by a punching system at the production side of the second conveyor belt (400, $CB_2$). The advantage that this is done at the production side is that the tolerance of the position from the mark and/or cut-out on the second conveyor belt (400, $CB_2$) can be in less than 100 μm.

In a preferred embodiment the second conveyor belt (400, $CB_2$) has the following characteristics:

- high temperature resistance from −40° C. up to 95° C.; and/or
- no electrostatic charging problems; and/or
- high chemical resistance; and/or
- recyclable for example through appropriate polyester (PET) recycling channels; and/or
- tear resistance, following ASTM D1938 test method, from 500 nM up to 1200 nM and preferably more than 1100 nM.

The stiffness of the second conveyor belt (400, $CB_2$) in the present invention is important else it is possible to have creases when the second conveyor belt (400, $CB_2$) is attached to the first conveyor belt (300, $CB_1$). The tear resistance, initial strength, conductivity, temperature resistance are also meaningful to have a good image quality, such as color registration, of the marked pattern on the print receiver (200). The pitch line of the second conveyor belt (400, $CB_2$) is preferably below one third of the thickness of the second conveyor belt (400, $CB_2$), more preferably below one fifth of the thickness of the second conveyor belt (400, $CB_2$), measured from the back-side of the second conveyor belt (400, $CB_2$), which is the side in contact of its wrapped sliding supports.

The print receiver (200) may be laminated together with the second conveyor belt (400, $CB_2$), for example by glue or a sticky second conveyor belt (400, $CB_2$) before marking and be delaminated from the second conveyor belt (400, $CB_2$) after marking the print receiver (200). The lamination, performed by a laminator, may comprising:

- method of adding heat to the second conveyor belt (400, $CB_2$) and/or print receiver (200); and/or;
- method of adding pressure to the second conveyor belt (400, $CB_2$) and/or print receiver (200) and/or;
- method of applying glue to the second conveyor belt (400, $CB_2$) and/or print receiver (200) so a layer of glue is comprised in the laminated product of print receiver (200) and second conveyor belt (400, $CB_2$). The glue, also called adhesive, may be water soluble adhesives, thermoplastic adhesive, pressure sensitive adhesive and permanent adhesives. The laminator is controlled by the printing device such as heat household. The delamination, performed by a delaminator, also called splitting performed by a splitting device, may comprising:
- method of adding heat to the laminated product of print receiver (200) and second conveyor belt (400, $CB_2$); and/or
- method of cooling the laminated product of print receiver (200) and second conveyor belt (400, $CB_2$); and/or
- method of applying tractive force, also called pulling power, on the laminated product of print receiver (200) and second conveyor belt (400, $CB_2$) to pull apart the marked print receiver (200) and second conveyor belt (400, $CB_2$); and/or
- method of adding pressure to the laminated product of print receiver (200) and second conveyor belt (400, $CB_2$).

The delaminator may be controlled by the printing device or controlled by attached sensors in the printing device which measures the speed of the laminated product of print receiver (200) and second conveyor belt (400, $CB_2$).

The delamination is done after the printing area ($A_{print}$) in the downstream area or even after the downstream sliding support (450) contact position ($C_{S,\ downstream}$) which is also a preferred delamination position when the print receiver (200) is a web material.

The method of applying tractive force for delamination is preferably done in an angle from 30° C. to 150° C., more preferably in an angle 45° C. to 135° C., most preferable in angle 60° C. to 120° C., where in the angle is formed between the second conveyor belt (400, $CB_2$) and the print receiver (200) after delamination.

If the path of the second conveyor belt (400, $CB_2$) in the conveying position from upstream side to downstream side is followed, the following positions in the printing device are passed while moving the second conveyor belt (400, $CB_2$) and shall return due to the loop of the second conveyor belt (400, $CB_2$):

$POS_{2,1}$: upstream sliding support (450) contact position ($C_{s,upstream}$) of second conveyor belt (400, $CB_2$)

$POS_{2,2}$: upstream contact position of the second conveyor ($CB_2$) with first conveyor belt ($C_{CB1,\ upstream,\ CB2}$)

$POS_{2,3}$: print area ($A_{print}$)

$POS_{2,4}$: downstream contact position of the second conveyor ($CB_2$) with first conveyor belt ($C_{CB1,\ downstream,\ CB2}$)

$POS_{2,5}$: downstream sliding support (450) contact position ($C_{S,downstream}$) of second conveyor belt (400, $CB_2$).

$POS_{2,X}$: The upstream contact position of the print receiver (200) with the second conveyor belt ($C_{CB2,\ upstream,\ printreceiver}$) may be:

- after passing $POS_{2,1}$ and before passing $POS_{2,3}$
- after passing $POS_{2,2}$ and before passing $POS_{2,3}$
- after passing $POS_{2,5}$, after passing $POS_{2,Y}$ and before passing $POS_{2,1}$ $POS_{2,Y}$: The downstream contact position of the print receiver (200) with the second conveyor belt ($C_{CB2,\ downstream,\ printreceiver}$) may be:

- after passing $POS_{2,3}$ and before passing $POS_{2,4}$
- after passing $POS_{2,3}$ and before passing $POS_{2,5}$
- after passing $POS_{2,5}$, before passing $POS_{2,X}$ and before passing $POS_{2,1}$ If the path of the first conveyor belt (300, $CB_1$) in the conveying position from upstream side to downstream side is followed, the following positions in the printing device are passed while moving the first conveyor belt (300, $CB_1$) and shall return due to the loop of the first conveyor belt (300, $CB_1$):

$POS_{1,1}$: contact position of first conveyor belt (300, $CB_2$) with the upstream pulley ($P_{upstream}$)

$POS_{1,2}$: contact position of print receiver (200) where the print receiver (200) is attached to the first conveyor belt ($C_{CB1,\ upstream,printreceiver}$)

$POS_{1,3}$: print area ($A_{print}$) which is equal to $POS_{2,3}$ $POS_{1,4}$: contact position of print receiver (200) where the print receiver (200) is detached from the first conveyor belt ($C_{CB1,\ downstream,printreceiver}$)

$POS_{1,5}$: contact position of first conveyor belt (300, $CB_2$) with the downstream pulley ($P_{downstream}$)

$POS_{1,1}$ is a position passed by the second conveyor belt (400, $CB_2$) after $POS_{2,1}$.

$POS_{2,\ 5}$ is a position passed by the second conveyor belt (400, $CB_2$) after $POS_{1,\ 5}$.

$POS_{2,X}$: The upstream contact position of the print receiver (200) with the second conveyor belt ($C_{CB2,\ upstream,\ printreceiver}$) is preferably before $POS_{1,2}$ is passed by the second conveyor belt or preferably on $POS_{1,2}$ is passed by the second conveyor belt (400, $CB_2$).

$POS_{2,Y}$: The downstream contact position of the print receiver (200) with the second conveyor belt ($C_{CB2,\ downstream,\ printreceiver}$) is preferably after $POS_{1,4}$ is passed by the second conveyor belt (400, $CB_2$) or preferably on $POS_{1,4}$ is passed by the second conveyor belt (400, $CB_2$).

The second conveyor belt (400, $CB_2$) may comprise a layer at the support side, which is the side whereon the print receiver (200) is carried, wherein the layer has a certain average Roughness ($R_a$) for a better adhering of the print receiver (200) on top of the second conveyor belt (400, $CB_2$).

Sticky Second Conveyor Belt

In a preferred embodiment is the second conveyor belt (400, $CB_2$) in the present invention a sticky conveyor belt which means that print receiver (200) is adhered to the second conveyor belt (400, $CB_2$) when conveying the print receiver (200). In a preferred embodiment comprises the sticky second conveyor belt (400, $CB_2$) a sticky layer for adhere the print receiver (200) on the sticky second conveyor belt (400, $CB_2$) when conveying the print receiver (200). The print receiver (200) is carried on the sticky second conveyor belt (400, $CB_2$) from a start location to an end location. A good adherence is important to achieve a good print quality. For example a good adherence of the print receiver (200) avoids misalignment between colors of marked pattern which can cause color shifts marked pattern. The second conveyor belt (400, $CB_2$) may comprise one or more sticky zones.

The advantageous effect of using a sticky conveyor belt allows an exact positioning of a print receiver (200) on the sticky conveyor belt. Another advantageous effect is that the print receiver (200) shall not be stretched and/or deformed while the print receiver (200) is carried from the start location to the end location. The sticky conveyor belt keeps the print receiver (200); such as fabric; dimensionally stable during the marking of a pattern. The print receiver (200) cannot be stretched or having wrinkles so the marked pattern is not distorted after coming off the printing device.

The sticky layer in a sticky zone of the second conveyor belt (400, $CB_2$) may be any adhesive such as water soluble adhesives, thermoplastic adhesive, pressure sensitive adhesive and permanent adhesives. It is known that depending on the print receiver (200) another glue type is preferred. The advantage of the present invention is that the second conveyor belt (400, $CB_2$) can easily be changed depending on the print receiver (200) that have to be carried and transported in the printing device, such as an inkjet printer. The present conveyor belt becomes an easily changeable consumable for the printing device.

The adhesive may comprise pigments and/or dyes to easily detect the sticky zone, also called adhesive zone; on the second conveyor belt (400, $CB_2$) by the operator of the printing device, such as an inkjet printer.

The adhesive may be applied in the printing device of the present invention by an adhesive applicator by forming a sticky zone. Such an adhesive applicator may comprise a doctor blade for applying in a coating method a uniform (e.g. equal thickness) adhesive layer on the second conveyor belt (400, $CB_2$) from the present invention. Another way applying an adhesive on the second conveyor belt (400, $CB_2$) is spraying the adhesive on the second conveyor belt (400, $CB_2$). The second conveyor belt (400, $CB_2$) may be a sticky conveyor belt film or sticky rectangular film whereon the adhesive is already applied before the mounting of the second conveyor belt (400, $CB_2$) in the printing device. This has the advantage that it is easier to apply a more uniform adhesive layer on the second conveyor belt (400, $CB_2$) while confectioning the sticky conveyor belt at the manufacturing side of these conveyor belts than when it is done by the operator or adhesive applicator in the printing device.

Normally it is preferred that the adhesion between print receiver (200) and adhesive layer is smaller than the adhesive cohesion in the adhesive layer and adhesion between adhesive layer and second conveyor belt (400, $CB_2$) from the present invention.

The adhesive may be a combination of water soluble adhesives, thermoplastic and/or permanent adhesives or may be multiple layers wherein each layer is selected from the group of water soluble adhesives, thermoplastic adhesives, pressure sensitive adhesive and/or permanent adhesives. For example a thermoplastic adhesive layer attached on the second conveyor belt (400, $CB_2$) may have a water soluble adhesive on top for conveying the printing receivers. The selection of the adhesive from the group water soluble adhesives, thermoplastic adhesives, pressure sensitive adhesive and permanent adhesives depends on the print receivers that has to be conveyed and marked in the printing device and the material of the second conveyor belt (400, $CB_2$).

The material of the second conveyor belt (400, $CB_2$) may have a lightly rough surface whereon the adhesive is applied for a better adhesion of the adhesive on the material of the second conveyor belt (400, $CB_2$). The roughness on this surface may be applied mechanically by brushes but also by applying a silica powder on this surface before applying the adhesive on the second conveyor belt (400, $CB_2$).

The water soluble adhesive may be formulated from natural polymers such as polymers from vegetable sources (e.g. dextrins, starches), protein sources (e.g. casein, blood, fish, soybean, milk albumen), and animal (e.g. bones) and/or soluble synthetic polymers such as polyvinyl alcohol, cellulose ethers, methylcellulose, carboxymethylcellulose, and polyvinylpyrrolidone. Many water-based solution adhesives are perishable and so extended storage is not possible.

A water soluble adhesive comprises Poly(vinyl alcohol) (PVOH, PVA, or PVAl) which is a water-soluble synthetic polymer. It has the idealized formula $[CH_2CH(OH)]_n$. The disadvantage of such water soluble adhesives if applied on the second conveyor belt (400, $CB_2$) in the printing device by an adhesive applicator is that whenever the machine stops or the printing process is scheduled to be stopped (e.g. on weekends), the adhesive applicator must be cleaned. For example if the adhesive applicator comprises a doctor blade the adhesive will dry and cake on the doctor blade. This may result in mechanical damage in scratches on the top surface of the second conveyor belt (400, $CB_2$) when operation restarts. The adhesion of polyvinyl alcohol (PVA) adhesives may be improved by adding 5-20% of ethanol to the adhesive; preferably by adding 10-15% of ethanol to the adhesive.

Thermoplastic adhesive, sometimes also called hot melt adhesive or hot glue is an adhesive which comes sticky after applying heat by a heat source for example an infrared source. The tackiness is temporarily. It remains sticky until the temperature on the sticky layer is lowered to a certain temperature; such as room temperature or a temperature lower than 40 degrees or lower than 30 degrees. The printing device may comprise such a heat source preferably an infrared (IR) source. This heat source may also be used to change the temperature of the print receiver (200) carried by the second conveyor belt (400, $CB_2$) of the present invention.

The IR source is preferably a NIR source (=Near Infra Red source) such as a NIR lamp or a SWIR (=Short Wave Infra Red source) such as a SWIR lamp. The IR source may comprise carbon infrared emitters which has a very short response time. An IR source is also called infrared radiation source.

Preferred infrared radiation sources include near infrared radiation sources (NIR: 750-1400 nm) and short wave infrared radiation sources (SWIR: 1400-3000 nm). An advantage is that glass lenses, which may be included in the curing device for focusing the infrared light on the substrate, transmit in this infrared region, contrary to mid-wavelength infrared light (MWIR: 3000-8000 nm) or long-wavelength infrared light (LWIR: 8000-15000 nm). The most preferred infrared light source is a SWIR light source because the water absorption significantly increases at 1450 nm. A commercial example of a SWIR light source is a carbon infrared emitter CIR™ available from HERAEUS, for example emitting at a wavelength of about 2000 nm. Commercially available NIR emitters are available from ADPHOS™

In a preferred embodiment becomes the thermoplastic adhesive tacky between 50 degrees and 85 degrees Celsius; more preferably between 45 degrees and 70 degrees Celsius. If the thermoplastic adhesive is too warm it may deform the print receiver (200) on top of the adhesive layer which may result in a bad print quality.

In a preferred embodiment the second conveyor belt (400, $CB_2$) is warmed up. This may be performed by passing the second conveyor belt (400, $CB_2$) while conveying. The up-warming is done by heat sources (IR, NIR, SWIR, CIR™) and/or blowing hot air, positioned above the sticky side of the second conveyor belt (400, $CB_2$) and/or underneath the back side of the second conveyor belt (400, $CB_2$) which is the side in contact with the pair of gliding supports. This heat source may also be used to change the temperature of the print receiver (200) carried by the second conveyor belt (400, $CB_2$) of the present invention. The first conveyor belt (300, $CB_1$) may also be a warmed-up for warming-up the second conveyor belt (400, $CB_2$) when it is in contact to each other. The warming-up of the first conveyor belt (300, $CB_1$) may be performed by heat sources (IR, NIR, SWIR, CIR™) above and/or under the first conveyor belt (300, $CB_1$) and/or blowing hot air above the support side of the first conveyor belt (300, $CB_1$).

Permanent adhesive is also called cold adhesive or cold glue. An example is ADESIVO™ 642 from ATR CHEMICALS™ (www.atrchemicals.com). Permanent adhesives are already tacky at room temperature (+/−20° C.).

Pressure sensitive adhesive, also abbreviated by PSA, is an adhesive which stick the material of the sticky conveyor belt and the print receiver (200) to each other by applying a pressure so it doesn't require a chemical reaction to develop adhesion forces.

Another preferable sticky conveyor belt from the present invention comprises a fibrillar adhesive system in a sticky zone, more preferably synthetic *setae* in a sticky zone; whether or not with an adhesive as in the previous preferred embodiment; to hold the print receiver (200) stable while printing on the print receiver (200). Holding the print receiver (200) stable while printing on the print receiver (200) is necessary e.g. to avoid misalignment or color shifts in the printed pattern on the print receiver (200). The fibrillar adhesive system may be emulations of adhesive systems of the toes of a beetle, fly, spider or gecko. The synthetic setae are emulations of *setae* found on the toes of geckos. More information on this type of sticky conveyor belt and its advantages are disclosed in WO2015110350 (AGFA GRAPHICS NV). Commercial implementations of such dry adhesive technology are nanoGriptech's Setex™ (http://nanogriptech.com/products/dry-adhesives) and Geckskin™ (https://geckskin.umass.edu/).

It is found that a fibrillar adhesive system in a sticky zone of the sticky conveyor belt is less dependent on the type of print receiver (200). With the applying of an adhesive in a sticky zone the chemistry of the adhesive is selected on the type of print receiver (200): for example permanent adhesives for cotton and thermoplastic adhesives for synthetic fabrics.

The advantage of the present invention is the fast changes between the several types of adhesives become possible by only replacing the second conveyor belt (400, $CB_2$) so the printing device can handle more different kind of print receivers which is a economically advantage. In the classic way the conveyor belt have to be cleaned if another adhesive has to be used which is unhealthy for the operator of the printing device. This takes several hours. In the present invention the second conveyor belt (400, $CB_2$) can easily be removed by cutting along the width of the second conveyor belt (400, CB2) and replaced by another second conveyor belt (400, $CB_2$) comprising another type of adhesive.

The sticky conveyor belt may be cleaned by a wash station for removing residual ink from the printing device and/or fibers from the print receivers. The wash station; preferably comprised in a treatment station; may comprise a rotating brush for the cleaning and a squeegee for drying prior receiving a print receiver (200) on the sticky conveyor belt. Preferably the treatment station comprises a brush rotatable in a predetermined direction in contact with the surface of the second conveyor belt (400, $CB_2$) for removing the residual ink on the sticky conveyor belt; scavenger roller rotatable to a predetermined direction in contact with the brush for collecting the residual ink from the brush and a scraper in contact with scavenger roller for scraping the collected adhesive. If the sticky conveyor belt is made sticky by an adhesive, after the washing a layer of adhesive may be applied on the sticky conveyor belt to remain a uniform adhesive layer, as restoration, on the sticky conveyor belt. The restoration of the sticky zone may be performed by applying a coating with a coating roll or coating spray head.

Rectangular Film

The second conveyor belt (400, $CB_2$) may be a rectangular film which is converted to the second conveyor belt (400, $CB_2$) by stitching the opposite ends of the rectangular film. This may be done by the operator of the printing device and this may be performed on the installation of the printing device or the changing of the second conveyor belt (400, $CB_2$) for example when the second conveyor belt (400, $CB_2$) is too dirty.

The second conveyor belt (400, $CB_2$) may be a printing device consumable that has to be changed regularly for examples eight times a year. The second conveyor belt (400, $CB_2$) as product is also an embodiment of the present invention. All preferred embodiments with characteristics on the second conveyor belt (400, $CB_2$) also apply on the second conveyor belt (400, $CB_2$) as product which may be a disposable conveyor belt.

In one of our preferred embodiments the tensioning of the second conveyor belt (400, $CB_2$) between the upstream sliding support (450, $S_{upstream}$) and downstream sliding support (450, $S_{downstream}$) doesn't have to be very high. The second conveyor may hang rather loosely around the upstream sliding support (450, $S_{upstream}$) and downstream sliding support (450, $S_{downstream}$). So this untensioned manner of converting the rectangular film to a second conveyor belt (400, $CB_2$) makes it more easily. The second conveyor is. The second conveyor belt (400, $CB_2$) is preferably also wrapped around a splicing table. The splicing table is a table to guide and stitch both ends of a film to the wrapped second conveyor belt (400, CB2). This may be easily done by the operator of the printing device.

In a preferred embodiment the splicing table has clamping bars and guiding grooves to cut the rectangular film easily in the guiding grooves when looped around the first conveyor belt (300, $CB_1$) and wherein the clamping bars are used to hold the ends of the rectangular film in place during cutting and stitching. An example of such splicing table or splice table of Coast Controls™ (http://www.coastcontrols.com/). In a preferred embodiment the edges of the rectangular film are hold in place by vacuum force against a splicing table instead of clamping bars, because clamping bars may deface the rectangular film, especially when the rectangular film comprises a sticky layer. The stitching of the two ends may be done by applying a sticky tape at the backside of the rectangular film. It may also be done by hot pressing both ends to a strong joint. The printing device has preferably such hot pressing unit for joining the ends of rectangular film to convert the rectangular film in a second conveyor belt (400, $CB_2$).

Stitching may make a slight bump along the second conveyor belt (400, $CB_2$), by producing the seam at an angle relative to transverse axis of the second conveyor belt (400, $CB_2$); the seam gradually or incrementally crosses over the pair of sliding supports. As a result, the disturbance resulting from the seam is minimized.

The ends of the rectangular film are stitched preferably face to face to each other and not in overlap else the formed second conveyor belt (400, $CB_2$) has a height difference; also called a bump; on the second conveyor belt (400, $CB_2$) which may result in deformed marked patterns on a print receiver (200) and disturbance in the conveying of the second conveyor belt (400, $CB_2$) so the direction of an end from the rectangular film is preferably angled against the direction of the width from the rectangular film. In a preferred embodiment the stitching of both ends face to face of the rectangular film is done by applying at the back side or front side of both ends an adhesive film. This adhesive film has preferably a thickness lower than 0.2 mm and more preferably a thickness lower than 0.12 mm. The adhesive film of such thickness results in a small bump which is acceptable for image quality of the printed pattern on the print receiver (200). If the adhesive film is applied on the back side of the rectangular film to form the second conveyor belt (400, $CB_2$) and the rectangular film comprises a sticky layer on the front side of the rectangular film, it occurs that a small gap between the stitched ends is found. The small gap is preferably filled with the same adhesive as the adhesive layer from the sticky rectangular film for example by applying the adhesive and smoothing the adhesive in the small gap for example with a spatula and removing the excess of the applied adhesive.

The ends of the rectangular film are the connection sides of the rectangular film to convert the rectangular film to the second conveyor belt (400, $CB_2$). In a preferred embodiment comprise the rectangular film at one connection side of the rectangular film a female registration element and at the other connection side a male registration element. The linkage between female registration element and the male registration element on the rectangular film; if they are equal shaped and/or female is smaller than the male registration element; shall give no height difference or bump in the second conveyor belt (400, $CB_2$).

Preferably matches the male registration element with the female registration element in size. To convert the rectangular film to the second conveyor belt (400, $CB_2$) the female and male registration element are connected to each other. The advantage of adding such male and female registration elements is that the accuracy of supplying the second conveyor belt (400, $CB_2$) from the present invention over the pair of sliding supports is much higher and straightness of the path from the second conveyor belt (400, $CB_2$) can faster be achieved after wrapping and mounting the second conveyor belt (400, $CB_2$) around the first conveyor belt (300, $CB_1$). By cutting or punching the male and female registration elements at the manufacturing side of the rectangular films the position accuracy of the male and female registration elements can be guaranteed so a very good looping of the rectangular film can be achieved so the second conveyor belt (400, $CB_2$) conveys faster straight over the pair of sliding supports. The position tolerance on the position of the male and/or female registration elements is preferably less than 1 mm, more preferably less than 500 μm and most preferably less than 100 μm.

The rectangular film may have at one connection side of the rectangular film a female registration element and a male registration element. Or it may have multiple female registration elements at one connection side and an equal number of male registration elements at the other connection side.

Although it is possible to use different male and female registration elements on the connection sides as long as the two connection sides can be connected to each other, it is advantageous to use the same shape and size for the male and female registration elements on the rectangular film used for conversion to a second conveyor belt (400, $CB_2$) from the present invention.

In a preferred embodiment the male registration element fits the female registration element. Fitting of the male and female registration elements means that their size is approximately the same such that no large force is required to connect them. In a preferred embodiment, the male registration element is a bit smaller than the female registration element.

In another embodiment, the rectangular film comprises a plurality of female and male registration elements. There are no real restrictions in the shape of the female and male registration elements as long as they can fit into each other. In a preferred embodiment the rectangular film contains two female and two male registration elements, preferably with the female registration elements on one side of the rectangular film and the male registration elements on the other side of the rectangular film.

Another way of stitching is providing at the one connection side a thinning end towards the top side of the second conveyor belt (400, $CB_2$) and at the other connection side a thinning end towards the bottom side of the second conveyor belt (400, $CB_2$) so the stitching and thus conversion to a second conveyor belt (400, $CB_2$) is by overlapping both thinned connection side so a bump is minimized after stitching.

The disadvantage of such rectangular film as printing device consumable, especially when it is for a sticky conveyor film, is the method of packaging but for example by applying a film or paper; which is not sticky on both sides, on the sticky side of the sticky conveyor film this issue is solved. The non-sticky film may be removed before the conversion of the rectangular film to the second conveyor belt (400, $CB_2$) but preferably after the conversion. This makes this handling easier for a printing device operator.

The printer device may comprise a web break detector for security reasons when the second conveyor belt (400, $CB_2$) breaks.

Conveyor Belt Film

Another way of applying the second conveyor belt (400, $CB_2$) or changing the second conveyor belt (400, $CB_2$) in the printing device is hanging a conveyor belt film around the upstream sliding support (450, $S_{upstream}$) and downstream sliding support (450, $S_{downstream}$). Such a conveyor belt film is manufactured in advance as a rectangular film wherein the parallel sides are stitched together. In a preferred embodiment is the conveyor belt film an endless conveyor belt; also called an endless conveyor belt film. A non-endless conveyor belt film may cause a height difference on the conveyed print receiver (200) which has to be avoided in printing device because this influences the print quality of the marked pattern on the print receiver (200) badly.

In one of our preferred embodiments the tensioning of the second conveyor belt (400, $CB_2$) between the upstream sliding support (450, $S_{upstream}$) and downstream sliding support (450, $S_{downstream}$) doesn't have to be very high. The second conveyor belt (400, $CB_2$) may hang rather loosely around the upstream sliding support (450, $S_{upstream}$) and downstream sliding support (450, $S_{downstream}$). So this untensioned manner of hanging the conveyor belt film makes it easily to do. The ease of looping the second conveyor belt (400, $CB_2$) makes the printing device of the present invention a hybrid system wherein the first conveyor belt (300, $CB_1$) may be used for one kind of print receivers and wherein the second conveyor belt (400, $CB_2$) may be used for other kind of print receivers if they are handled difficult while conveying directly in contact with the first conveyor belt (300, $CB_1$) of the present invention.

The second conveyor belt (400, $CB_2$) may become dirty so the conveyor belt film may be a printing device consumable that has to be changed regularly for examples eight times a year. The second conveyor belt (400, $CB_2$) as product is also an embodiment of the present invention. All preferred embodiments with characteristics on the second conveyor belt (400, $CB_2$) also apply on the second conveyor belt (400, $CB_2$) as product which may be a disposable conveyor belt.

The advantage of using a conveyor belt film, as second conveyor belt (400, $CB_2$) and as printing device consumable, is that the conveying path of the second conveyor belt (400, $CB_2$) shall become easier for straight looping around the first conveyor belt (300, $CB_1$). The disadvantage of such conveyor belt film as printing device consumable, especially when it is for a sticky conveyor belt film, is the method of packaging but for example by applying a film or paper; which is not sticky on both sides; on the sticky side of the sticky conveyor film this issue is solved. The non-sticky film may be removed before the applying of the conveyor belt film in the printing device but preferably after the applying. This makes this handling easier for a printing device operator.

Web Guiding Unit

The second conveyor belt (400, $CB_2$) is preferably also wrapped around a web guiding unit for conveying straight the second conveyor belt (400, $CB_2$) substantially in the same direction as the first conveyor belt (300, $CB_1$).

The web guiding unit may be a pair of guiders, preferably movable guiders and more preferably movable guiders over one of the pulleys of the pair of sliding supports from the present invention. The distance between the pair of guiders equals the width of the second conveyor belt (400, $CB_2$) or is little bit larger than this width, preferably between 0 and 1 cm larger or more preferably between 0 and 5 mm larger. The second conveyor belt (400, $CB_2$) shall be held on place across the conveying direction of the second conveyor belt (400, $CB_2$) because the contact against one of these guiders shall guide the second conveyor belt (400, $CB_2$) on place. The virtual axis between the movable guiders is substantially parallel with the first and pair of sliding supports. The conveying direction is the direction of conveying the first and thus also the second conveyor belt (400, $CB_2$) in the present invention which is perpendicular to the axis of the pair of pulleys.

In a preferred embodiment one of the sliding supports ($S_{upstream}$ or $S_{downstream}$) of the pair of sliding supports from the present invention comprises a web guiding unit which comprises a pair of movable guiders over the sliding support (450) wherein between the second conveyor belt (400, $CB_2$) is conveyed. The distance between the pair of movable guiders, such as movable disks, is controlled to have substantially the same size as the width of the second conveyor belt (400, $CB_2$) from the present invention.

A more sophisticated web guiding unit that may be used comprises a web guiding sensor; such as an ultrasonic sensor and web guiding pivoting rollers. If the second conveyor belt (400, $CB_2$) is not straight looped around the first conveyor belt (300, $CB_1$); the web guiding unit will correct the cross position of the second conveyor belt (400, $CB_2$) so the conveying becomes straight. The web guiding may be controlled by a web guiding control panel. An example of such sophisticated web guiding unit is Web Guiding Systems ELGUIDER™ from E+L (Erhardt+Leimer) Ltd (http://www.erhardt-leimer.com).

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and the vacuum pump is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned. To prevent contamination, such as paper dust, substrate fibers, ink, ink residues and/or ink debris such as cured ink, to contaminate via the set of air-channels of the vacuum support and/or the set of vacuum-belt-air-channels from the vacuum support the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Vacuum Table

A vacuum table is a vacuum support. A vacuum chamber comprised in a printing device, hold-downs a print receiver (200) for fixing the print receiver (200) against the vacuum table.

To avoid registration problems while printing on a print receiver (200) and to avoid collisions while conveying a print receiver (200), the print receiver (200) needs to be connected to a support, also called a printing table. A vacuum table is a printing table wherein the print receiver (200) is connected to the printing table by vacuum pressure. A vacuum table is also called a porous printing table. Between the print receiver (200) and the vacuum table may be a vacuum conveyor belt when a vacuum conveyor belt is wrapped around the vacuum table.

Preferably the vacuum table in the embodiment comprises a set of air-channels to provide a pressure differential by a vacuum chamber at the support layer of the vacuum table to create a vacuum area ($A_{vacuum}$) and at the bottom-surface of the printing table a set of apertures which are connected to the set of air-channels. These apertures at the bottom layer may be circular, elliptical, square, rectangular shaped and/or grooves, such as slits, parallel with the bottom layer of the vacuum table.

The width or height of the vacuum table is preferably from 1.0 m until 10 m. The larger the width and/or height, the larger the print receiver (200) may be supported by the vacuum table which is an economical benefit.

An aperture at the bottom-surface and at the support surface of the vacuum table may be connected to one or more air-channels. An aperture at the bottom-surface or support surface of the vacuum table may be small in size, preferably from 0.3 to 12 mm in diameter, more preferably from 0.4 to 8 mm in diameter, most preferably from 0.5 to 5 mm in diameter and preferably spaced evenly apart on the vacuum support preferably 1 mm to 50 mm apart, more preferably from 4 to 30 mm apart and most preferably from 5 to 15 mm apart to enable the creation of uniform vacuum pressure that connects a print receiver (200) together with the vacuum table.

A set of apertures at the support layer of the vacuum table may be connected to the air-channels. These apertures at the support layer may be circular, elliptical, square, rectangular shaped and/or grooves, such as slits, parallel with the support layer of the vacuum table. Preferably, if the apertures are grooves, the grooves are oriented along the printing direction of the printing device.

Preferably the vacuum table of the embodiment comprising a honeycomb structure plate which is sandwiched between a top and bottom sandwich plate which comprises each a set of apertures connect to one or more air-channels in the vacuum table. The honeycomb cores, as part of the air-channels, in the honeycomb structure plate results in a better uniform vacuum distribution on the support surface of the vacuum table.

The dimensions and the amount of air-channels should be sized and frequently positioned to provide sufficient vacuum pressure to the vacuum table. Also the dimensions and the amount of apertures at the bottom-surface of the vacuum table should be sized and frequently positioned to provide sufficient vacuum pressure to the vacuum table. The dimension between two air-channels or two apertures at the bottom-surface of the vacuum table may be different. A honeycomb core is preferably sinusoidal or hexagonal shaped.

If a honeycomb structure plate is comprised in the vacuum table also the dimensions and the amount of honeycomb cores should be sized and frequently positioned to provide sufficient vacuum pressure to the vacuum table. The dimensions between two neighbour honeycomb cores may be different.

The support layer of the printing table should be constructed to prevent damaging of a print receiver (200) or vacuum support if applicable. For example the apertures at the support layer that are connected with the air-channels may have rounded edges. The support layer of the printing table may be configured to have low frictional specifications.

The vacuum table is preferably parallel to the ground whereon the printing device is connected to avoid misaligned marked patterns. The vacuum pressure in a vacuum area ($A_{vacuum}$) on the support surface of the vacuum table may couple the print receiver (200) and the vacuum table by sandwiching the vacuum conveyor belt that carries the print receiver (200). The coupling is preferably done while marking to hold down the print receiver (200) to avoid bad alignment and color-on-color register problems. The vacuum pressure in a vacuum area ($A_{vacuum}$) on the support surface of the vacuum table may apply sufficient normal force to the vacuum support when the vacuum support is moving and carrying a print receiver (200) in the conveying direction. The vacuum pressure may also prevent any fluttering and/or vibrating of the vacuum support or print receiver (200) on the vacuum support. The vacuum pressure in a vacuum area ($A_{vacuum}$) may be adapted while marking.

The top-surface, also called the support surface, of the vacuum table or a portion of the vacuum table, such as the inner side of its air-channels may be coated to have easy cleaning performances e.g. as result of dust or ink leaks. The coating is preferably a dust repellent and/or ink repellent and/or hydrophobic coating. Preferably the top-surface of the vacuum table or a portion of the vacuum table, such as the inner side of its air-channels, is treated with an ink repelling hydrophobic method by creating a lubricious and repelling surface which reduces friction.

Vacuum-Support-Air-Channel

A vacuum-support-air-channel is an air-channel from the support surface to the bottom surface of the vacuum support. It is also called a suction-hole if the perimeter of the vacuum-support-air-channel at the support surface is substantially circular.

The area of a vacuum-support-air-channel at the support surface of the vacuum support is in the present invention preferably between 0.3 $mm^2$ and 5 $mm^2$. More preferably the perimeter of the vacuum-support-air-channel at the support surface has the same shape as a circle, ellipse, oval, rectangle, triangle, square, rectangle, pentagon, hexagon, heptagon, octagon or any polygon containing at least three sides.

The vacuum-support-air-channel is preferably tapered in the direction of the bottom surface for optimal vacuum pressure effect at the support surface.

The distribution of air-channels on the support surface of the vacuum support is preferably between 1 air-channel per dm2 and 100 air-channels per $dm^2$; more preferably between 5 air-channels per $dm^2$ and 50 per $dm^2$.

The perimeter of a suction-hole is preferably from 0.3 to 10 mm in diameter, more preferably from 0.4 to 5 mm in diameter, most preferably from 0.5 to 2 mm in diameter The vacuum-belt-air-channels in the air-sucking zone; also called vacuum area ($A_{vacuum}$); are preferably spaced evenly apart on the vacuum support preferably 3 mm to 50 mm apart, more preferably from 4 to 30 mm apart and most preferably from 5 to 15 mm apart to enable the creation of uniform vacuum pressure that holds the print receiver (200) together with the vacuum support. Smaller the apertures in the vacuum support, higher the vacuum pressure at the top of the vacuum support.

REFERENCE SIGNS LIST

TABLE 1

| | |
|---|---|
| 50 | Print head |
| 100 | Inkjet printing device |
| 150 | Vacuum table |
| 175 | Roll |
| 185 | Roll |

TABLE 1-continued

| | |
|---|---|
| 200 | Print receiver |
| 250 | Image |
| 300 | First conveyor belt |
| 350 | Pulley |
| 400 | Second conveyor belt |
| 450 | Sliding support |
| 470 | Wash station |
| 490 | Restoration station |

The invention claimed is:

1. An inkjet printer comprising:

a first conveyor belt wrapped around a vacuum table and supported by an upstream pulley and a downstream pulley, the first conveyor belt including a vacuum area; and a second conveyor belt wrapped around the first conveyor belt and supported by an upstream sliding support and a downstream sliding support; wherein the second conveyor belt is removably adhered to the vacuum area of the first conveyor belt by vacuum such that the second conveyor belt is transported by the first conveyor belt; and a print receiver is attachable to the second conveyor belt to be conveyed and printed on.

2. The inkjet printer according to claim 1, wherein the second conveyor belt includes a sticky layer that conveys the print receiver and removably adheres the print receiver to the second conveyor belt.

3. The inkjet printer according to claim 2, wherein a tension of the second conveyor belt from the downstream sliding support to the upstream sliding support is lower than a tension of the first conveyor belt from the upstream pulley to the downstream pulley.

4. The inkjet printer according to claim 3, wherein the tension of the second conveyor belt from the downstream sliding support to the upstream sliding support is untensioned when the inkjet printer is printing on the print receiver.

5. The inkjet printer according to claim 2, wherein the sticky layer includes a water soluble adhesive, a thermoplastic adhesive, a pressure sensitive adhesive, a permanent adhesive, or a fibrillar adhesive.

6. The inkjet printer according to claim 1, wherein the print receiver is selected from the group consisting of a crease-sensitive print receiver, a brittle print receiver, an edge-curl sensitive print receiver, and a rough back-side print receiver.

7. The inkjet printer according to claim 1, wherein the inkjet printer is an inkjet textile printer, an inkjet leather printer, or a plastic foil printer.

8. The inkjet printer according to claim 1, wherein the upstream sliding support and/or the downstream sliding support includes a pulley.

9. An inkjet printing method in which a print receiver is conveyed in an inkjet printer that includes a first conveyor belt wrapped around a vacuum table and supported by an upstream pulley and a downstream pulley and including a vacuum area on the first conveyor belt, and a second conveyor belt removably wrapped around the first conveyor belt and supported by an upstream sliding support and a downstream sliding support, the method comprising:

transporting the second conveyor belt by the first conveyor belt:

adhering the second conveyor belt in the vacuum area by vacuum to the first conveyor belt; and attaching the print receiver to the second conveyor belt to convey the print receiver.

10. The inkjet printing method according to claim 9, wherein the step of attaching the print receiver includes attaching the print receiver to a sticky layer on the second conveyor belt.

11. The inkjet printing method according to claim 10, wherein a tension of the second conveyor belt from the downstream sliding support to the upstream sliding support is lower than a tension of the first conveyor belt from the upstream pulley to the downstream pulley during printing.

12. The inkjet printing method according to claim 11, wherein the tension of the second conveyor belt from the downstream sliding support to the upstream sliding support is untensioned during printing.

13. The inkjet printing method according to claim 9, wherein the second conveyor belt includes a film extruded from a thermoplastic polymer or including synthetic fibers, and the thermoplastic polymer and the synthetic fibers are selected from the group consisting of polyamides, polyester, polyolefins, and polyethylene.

14. The inkjet printing method according to claim 13, wherein the film is rectangular and includes a female registration element at a first side and a male registration element at a second side, and linking the female registration element and the male registration element forms the second conveyor belt.

15. The inkjet printing method according to claim 13, wherein the film includes marks to index a speed and/or a position of the second conveyor belt.

* * * * *